US007515868B2

(12) United States Patent
Miller et al.

(10) Patent No.: US 7,515,868 B2
(45) Date of Patent: Apr. 7, 2009

(54) STRIPPER ASSEMBLY AND A PRINTING MACHINE INCLUDING THE SAME

(75) Inventors: Gregory P. Miller, Rochester, NY (US); Erwin Ruiz, Rochester, NY (US); Mark Stevens, Henrietta, NY (US); Roger G. Bennett, II, Rochester, NY (US); Kenneth W. Luff, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 142 days.

(21) Appl. No.: 11/653,629

(22) Filed: Jan. 16, 2007

(65) Prior Publication Data

US 2007/0116504 A1 May 24, 2007

Related U.S. Application Data

(62) Division of application No. 11/058,031, filed on Feb. 2, 2005, now abandoned.

(51) Int. Cl.
*G03G 15/14* (2006.01)

(52) U.S. Cl. ..... 399/398; 271/308; 271/313; 271/306; 271/311; 271/312; 101/118; 399/397; 399/323

(58) Field of Classification Search ..... 399/398, 399/323; 271/308, 309, 306, 311, 312, 313; 101/118

See application file for complete search history.

(56) References Cited

U.S. PATENT DOCUMENTS 6,453,128 B2 * 9/2002 Park ..... 399/22
6,644,190 B2 * 11/2003 Jones ..... 101/425

* cited by examiner

*Primary Examiner*—Leslie J Evanisko
*Assistant Examiner*—Matthew G Marini
(74) *Attorney, Agent, or Firm*—Gibb I.P. Law Firm, LLC

(57) ABSTRACT

A stripper assembly strips a media sheet from a photoreceptor belt. A support bracket supports a stripping finger base which includes a multiplicity of attached stripping fingers. The support bracket is fixed proximate to the photoreceptor belt in a media stripping position. Each stripping finger has a protruding distal stripping end extending toward the photoreceptor belt to form a gap therewith. The magnitude of the stripping finger-photoreceptor belt gap is controlled by adjusting the position or spacing of the finger base with respect to the support bracket. The support bracket pivots about an inboard pivot axial. The opposite support bracket outboard end is releasable, thus enabling the support bracket to pivot away from the photoreceptor belt.

12 Claims, 15 Drawing Sheets

STRIPPER ASSEMBLY AND A PRINTING MACHINE INCLUDING THE SAME

CROSS-REFERENCE TO RELATED APPLICATION

This is a divisional of its commonly-assigned parent application Ser. No. 11/058,031 filed 2 Feb. 2005 now abandoned by the same inventors hereof, and claims the priority benefit of the same application under the provisions of 35 U.S.C. section 120.

BACKGROUND OF THE INVENTION

In xerographic printing machines it is known to use a stripper assembly consisting of a sheet metal support and thin plastic stripping fingers to help strip paper from the photoreceptor belt at the stripper roll, as shown in FIG. 1. A minimum gap initially 0.35 milli-meters ("mm") is required between the stripping fingers and the photoreceptor belt. Presently this gap is achieved by manually sliding the finger assembly against several pieces of 20-pound paper placed between the photoreceptor belt and the stripper assembly. When slight drag is felt by moving the paper, mounting screws are tightened to secure the finger assembly. The finger assembly tends to flex up and down and is deflected when tightening the screws. Due to the assembly's deflections, excessive clearances between components and lack of motion control, this set-up method is subjective and does not provide the consistent gap required. Also, the present design snaps on and off its mounts and must be removed for photoreceptor belt replacement. Should a jam occur between the fingers and the photoreceptor stripper roll, it will likely be unclearable for the customer.

Thus, there is a need for an improved stripper assembly.

BRIEF SUMMARY OF THE INVENTION

In a first aspect of the invention, there is described a stripper assembly arranged to strip a media sheet from a photoreceptor belt; the stripper assembly comprising a support bracket arranged to support an included stripping finger base, the stripping finger base having a multiplicity of individual stripping fingers attached thereto; the support bracket arranged to be fixed proximate to the photoreceptor belt in a media stripping position; each stripping finger having a protruding distal stripping end and an opposite stripping finger base end, with an upper media stripping surface extending therebetween, so that with the support bracket in the media stripping position the corresponding finger distal stripping end extends toward the proximate photoreceptor belt to thereby form a gap with the photoreceptor belt; the support bracket arranged to pivot about a pivot axial located at an included support bracket inboard end, the opposite support bracket outboard end being releasable to thus enable the support bracket to pivot away from the photoreceptor belt.

In a second aspect of the invention, there is described a stripper assembly arranged to strip a media sheet from a photoreceptor belt; the stripper assembly comprising a support bracket arranged to support an included stripping finger base; the support bracket arranged to be fixed proximate to the photoreceptor belt in a media stripping position; the stripping finger base having a multiplicity of individual stripping fingers attached thereto, each stripping finger having a protruding distal stripping end and an opposite stripping finger base end, with an upper media stripping surface extending therebetween, so that with the support bracket in the media stripping position the corresponding finger distal stripping end extends toward the proximate photoreceptor belt to thereby form a gap with the photoreceptor belt; the support bracket comprising an inboard guide pin and a parallel outboard guide pin, the corresponding inboard and outboard guide pin distal ends protruding outward away from the support bracket; the stripping finger base having an inboard guide pin hole and an outboard guide pin hole arranged for respectively engaging the inboard and outboard guide pins, thus enabling the stripping finger base to move along the inboard and outboard guide pins either towards or away from the support bracket.

In a third aspect of the invention, there is described a printing machine including a stripper assembly arranged to strip a media sheet from an included photoreceptor belt; the stripper assembly comprising a support bracket arranged to support an included stripping finger base, the stripping finger base having a multiplicity of individual stripping fingers attached thereto; the support bracket arranged to be fixed proximate to the photoreceptor belt in a media stripping position; each stripping finger having a protruding distal stripping end and an opposite stripping finger base end, with an upper media stripping surface extending therebetween, so that with the support bracket in the media stripping position the corresponding finger distal stripping end extends toward the proximate photoreceptor belt to thereby form a gap with the photoreceptor belt; the support bracket arranged to pivot about a pivot axial located at an included support bracket inboard end, the opposite support bracket outboard end being releasable to thus enable the support bracket to pivot away from the photoreceptor belt.

In a fourth aspect of the invention, there is described a printing machine including a stripper assembly arranged to strip a media sheet from an included photoreceptor belt; the stripper assembly comprising a support bracket arranged to support an included stripping finger base; the support bracket arranged to be fixed proximate to the photoreceptor belt in a media stripping position; the stripping finger base having a multiplicity of individual stripping fingers attached thereto, each stripping finger having a protruding distal stripping end and an opposite stripping finger base end, with an upper media stripping surface extending therebetween, so that with the support bracket in the media stripping position the corresponding finger distal stripping end extends toward the proximate photoreceptor belt to thereby form a gap with the photoreceptor belt; the support bracket comprising an inboard guide pin and a parallel outboard guide pin, the corresponding inboard and outboard guide pin distal ends protruding outward away from the support bracket; the stripping finger base having an inboard guide pin hole and an outboard guide pin hole arranged for respectively engaging the inboard and outboard guide pins, thus enabling the stripping finger base to move along the inboard and outboard guide pins either towards or away from the support bracket.

In a fifth aspect of the invention, there is described a stripper assembly arranged to strip a media sheet from a photoreceptor belt; the stripper assembly stripping finger base, the stripping finger base having a multiplicity of individual stripping fingers attached thereto; the stripping finger base arranged to be fixed proximate to the photoreceptor belt in a media stripping position; each stripping finger having a protruding distal stripping end and an opposite stripping finger base end, with an upper media stripping surface extending therebetween, so that with the stripping finger base in the media stripping position the corresponding finger distal stripping end extends toward the proximate photoreceptor belt to thereby form a gap with the photoreceptor belt; the stripping finger base arranged to pivot about a pivot axial located at an included stripping finger base inboard end, the opposite stripping finger base outboard end being releasable to thus enable the stripping finger base to pivot away from the photoreceptor belt.

In a sixth aspect of the invention, there is described a printing machine including a stripper assembly arranged to strip a media sheet from an included photoreceptor belt; the stripper assembly stripping finger base, the stripping finger base having a multiplicity of individual stripping fingers attached thereto; the stripping finger base arranged to be fixed proximate to the photoreceptor belt in a media stripping position; each stripping finger having a protruding distal stripping end and an opposite stripping finger base end, with an upper media stripping surface extending therebetween, so that with the stripping finger base in the media stripping position the corresponding finger distal stripping end extends toward the proximate photoreceptor belt to thereby form a gap with the photoreceptor belt; the stripping finger base arranged to pivot about a pivot axial located at an included stripping finger base inboard end, the opposite stripping finger base outboard end being releasable to thus enable the stripping finger base to pivot away from the photoreceptor belt.

BRIEF DESCRIPTION OF THE SEVERAL VIEWS OF THE DRAWING

FIG. 4 includes three parallel reference lines 91-93. Reference line 91 is coincident with the axial of an included inboard guide pin 443. Reference line 92 is coincident with an included typical stripping finger 410.n. Reference line 93 coincident with the axial of an included outboard pin guide 446. Also shown is a first arrow labeled "X" which is parallel to reference lines 91-93 and pointed towards the depicted stripper roll axial 2'. Also shown is a second arrow labeled "Y" which is orthogonal to both the first arrow X and the stripper roll axial 2'.

FIG. 7 includes three parallel reference lines 94-96. Reference line 94 is coincident with the axial of an included inboard guide pin 543. Reference line 95 is coincident with an included typical stripping finger 510.n. Reference line 96 coincident with the axial of an included outboard pin guide 546. Also shown is a first arrow labeled "X" which is parallel to reference lines 91-93, and pointed towards the depicted stripper roll axial 2'. Also shown is a second arrow labeled "Y" which is orthogonal to both the first arrow X and the stripper roll axial 2'.

DETAILED DESCRIPTION OF THE INVENTION

Briefly, a stripper assembly strips a media sheet from a photoreceptor belt. A support bracket supports a stripping finger base which includes a multiplicity of attached stripping fingers. The support bracket is fixed proximate to the photoreceptor belt in a media stripping position. Each stripping finger has a protruding distal stripping end extending toward the photoreceptor belt to form a gap therewith. The magnitude of the stripping finger-photoreceptor belt gap is controlled by adjusting the position or spacing of the finger base with respect to the support bracket. The support bracket pivots about an inboard pivot axial. The opposite support bracket outboard end is releasable, thus enabling the support bracket to pivot away from the photoreceptor belt.

Figure 1:
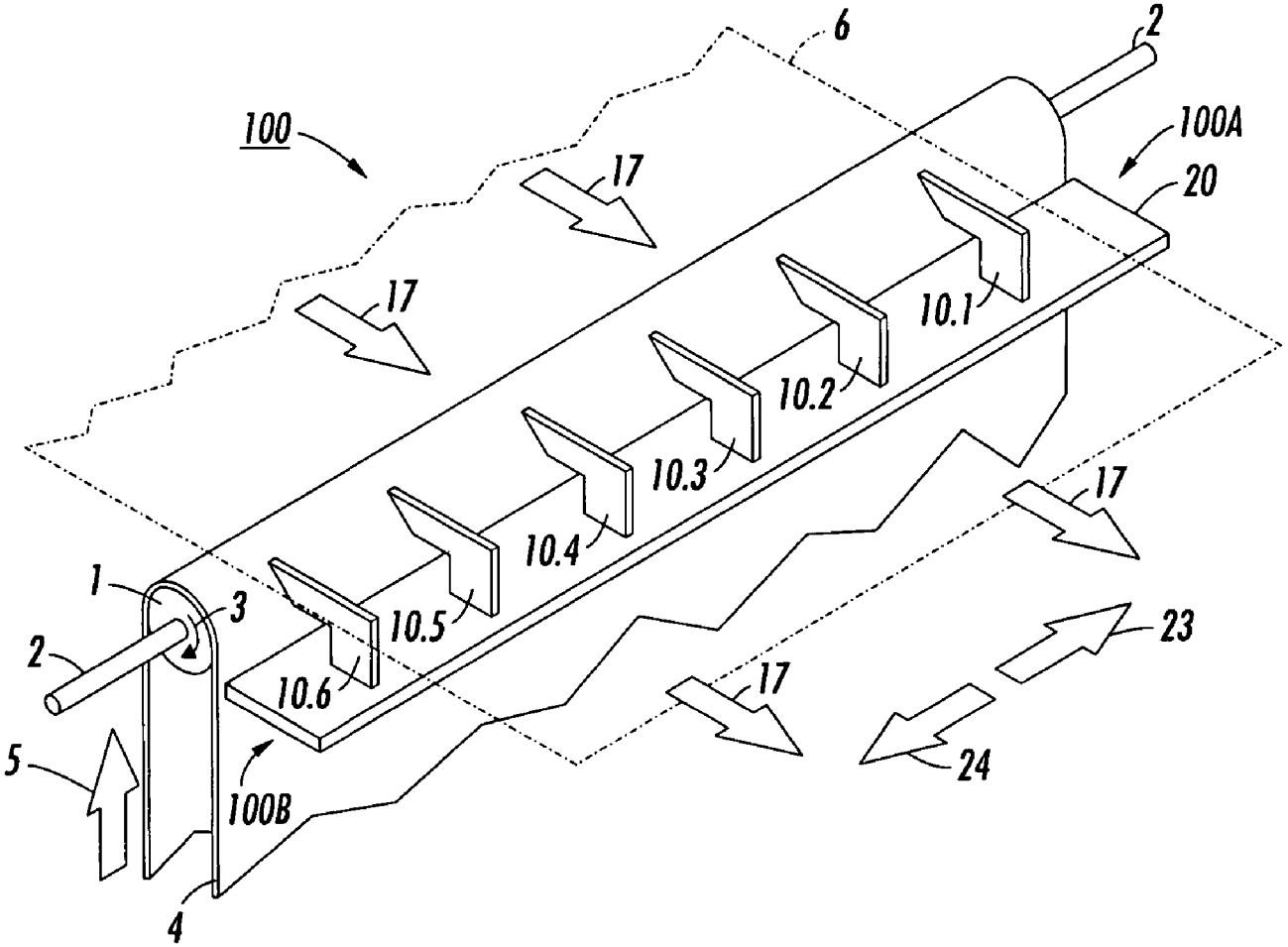
FIG. 1 PRIOR ART
FIG. 1 is a detached elevated perspective view of an existing stripper assembly 100. As shown, the stripper assembly 100 comprises individual stripper fingers depicted by reference numbers 10.1 through 10.6, with a typical stripper finger being depicted by reference number 10.n.

Referring now to FIG. 1, there is shown a detached elevated perspective view of an existing stripper assembly 100. The stripper assembly 100 comprises a stripper assembly base 20 including an attached multiplicity (N) of individual protruding stripping fingers depicted by reference number 10. As shown, the stripper assembly 100 comprises six (6) stripping fingers 10, hence the quantity of stripping fingers, represented by the symbol "N", equals 6. The individual stripping fingers 10 are respectively depicted by reference numbers 10.1 through 10.6. As shown, the stripping fingers 10.1 through 10.n are arranged to strip the body of a sheet of media 6 from a photoreceptor belt 4 mounted on a proximate stripper roll 1. The stripper roll 1 rotates about an included stripper roll bearing 2. The photoreceptor belt 4 moves in direction 5, the stripper roll 1 rotates in direction 3, and the media moves in a downstream or spanwise direction 17. An included inboard direction is depicted by reference number 23 and an included outboard direction is depicted by reference number 24.

Figure 2:
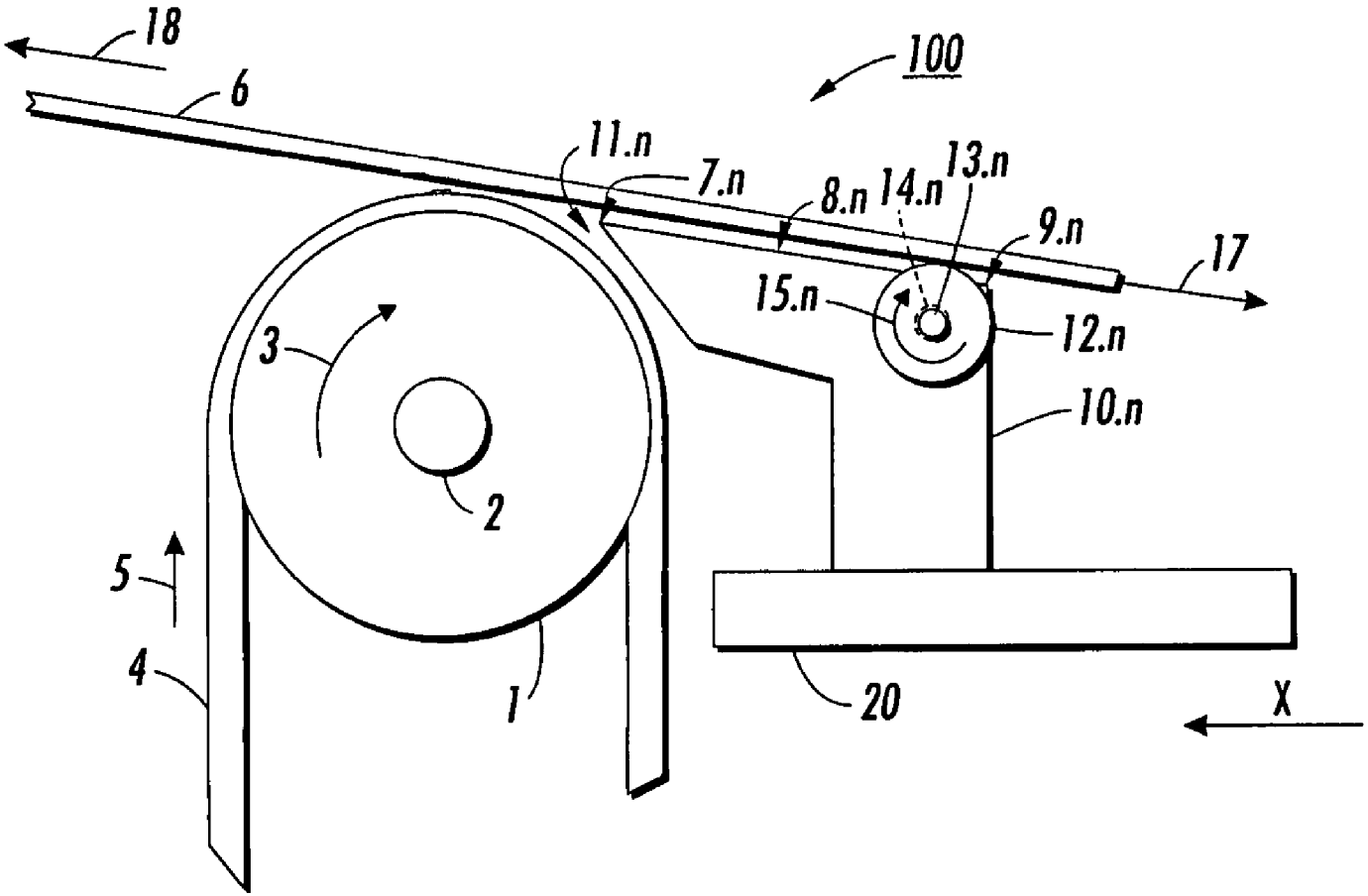
FIG. 2 PRIOR ART
FIG. 2 is a cutaway profile view of a typical stripper finger 10.n of the stripper assembly 100 of FIG. 1.

Referring now to FIG. 2, there is shown a cutaway profile view of a typical stripper finger 10.n of FIG. 1. As shown, the finger 10.n comprises a finger distal stripping end 7.n, an upper stripping surface 8.n and a finger base end 9. The distance between the stripping end 7.n and the proximate photoreceptor belt 4 forms a corresponding stripping finger-photoreceptor belt gap 11.n.

Figure 3:
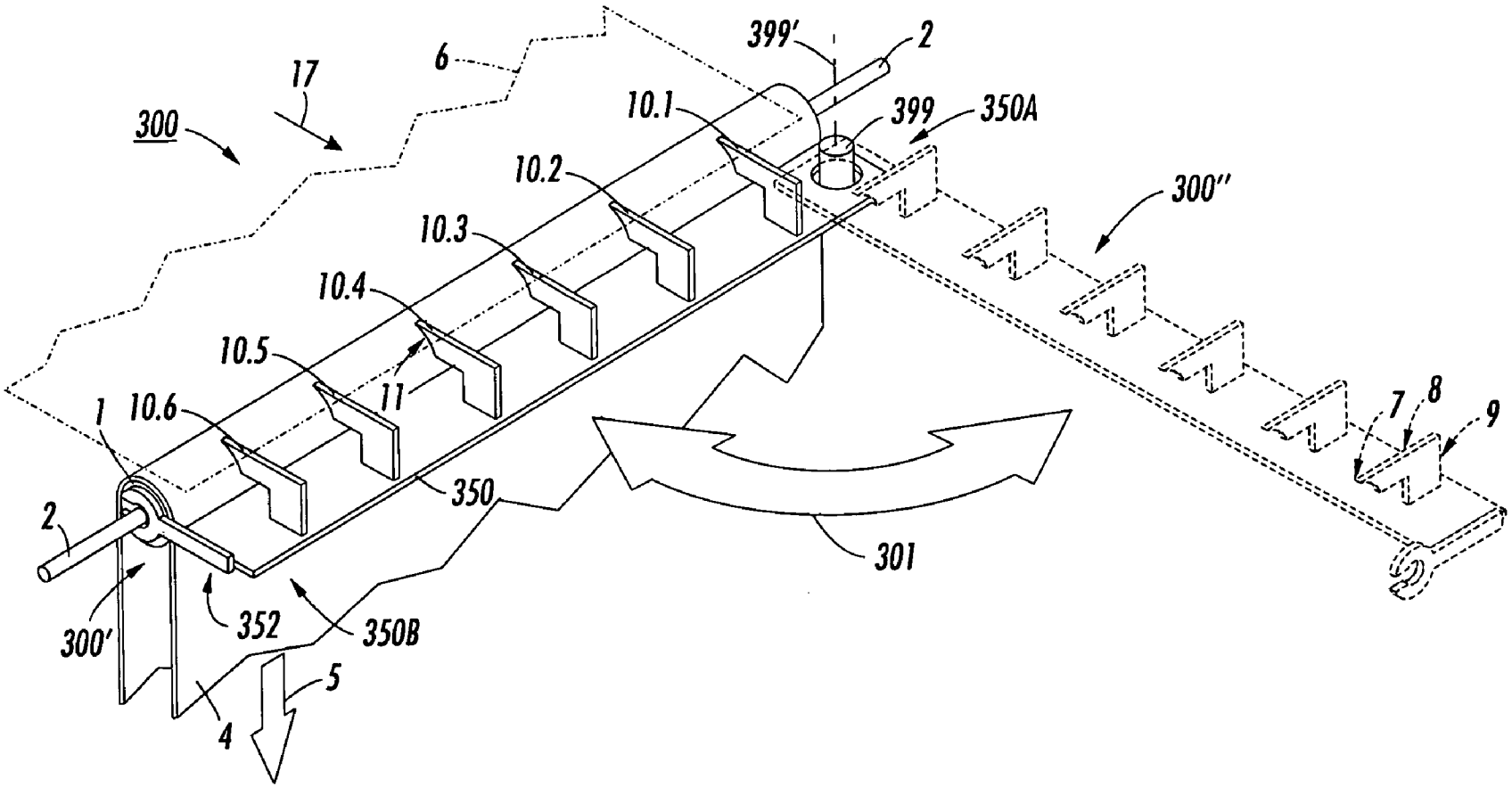
FIG. 3 is a detached elevated perspective view of one embodiment 300 of a stripper assembly, in accordance with the present invention.

Referring now to FIG. 3, there is shown a detached elevated perspective view of one embodiment 300 of a stripper assembly, in accordance with the present invention. The stripper assembly 300 comprises a stripping finger base 350 with an attached multiplicity (N) of six (6) individual stripping fingers respectively depicted by reference numbers 10.1 through 10.6. Also provided is a pivot axle 399 arranged to be supported by a suitable pivot base such as, for example, a host printing machine housing.

As shown, the stripper assembly 300 is arranged to strip a media sheet 6 from a photoreceptor belt 4. The photoreceptor belt 4, in turn, is mounted on a stripper roll 1.

The stripping finger base 350 is arranged to be held stationary or fixed proximate to the photoreceptor belt 4 by means of an included stripper assembly outboard latch 352 in a media stripping position 300'.

As shown, each stripping finger has a protruding distal stripping end 7 and an opposite stripping finger base end 9, with an upper media stripping surface 8 extending therebetween so that, with the stripping finger base 350 in the media stripping position 300', the corresponding finger distal stripping end 7 extends toward the proximate photoreceptor belt 4 to thereby form a gap 11 with the photoreceptor belt 4.

The stripping finger base 350 is arranged to pivot 301 about a pivot axial 399'. As shown, the pivot axial 399' is located at the stripping finger base inboard end 350A. The outboard latch 352 is detachable from the stripper roll bearing 2, thus enabling the stripping finger base outboard end 350B to be released from the stationary media stripping position 300'. Once released, the stripping finger base 350 is thus enable to pivot. 301 away from the photoreceptor belt 4. The stripper assembly 300 pivot-open position is depicted by reference number 300".

While FIG. 3 depicts the stripper assembly 300 comprising a multiplicity (N) of individual stripping fingers 10 wherein the quantity of stripping fingers, represented by the symbol "N", equals 6, those skilled in the art will understand that in an alternate embodiment the stripper assembly 300 comprises a multiplicity (N) of individual stripping fingers 10 wherein N equals a value other than 6.

Thus, in one alternate embodiment of the stripper assembly 300, N equals a value less than 6 such as, for example, 5, 4, or a still lesser value.

Further, in another alternate embodiment of the stripper assembly 300, N equals a value greater than 6 such as, for example, 7, 8, or a still greater value.

Figure 4:
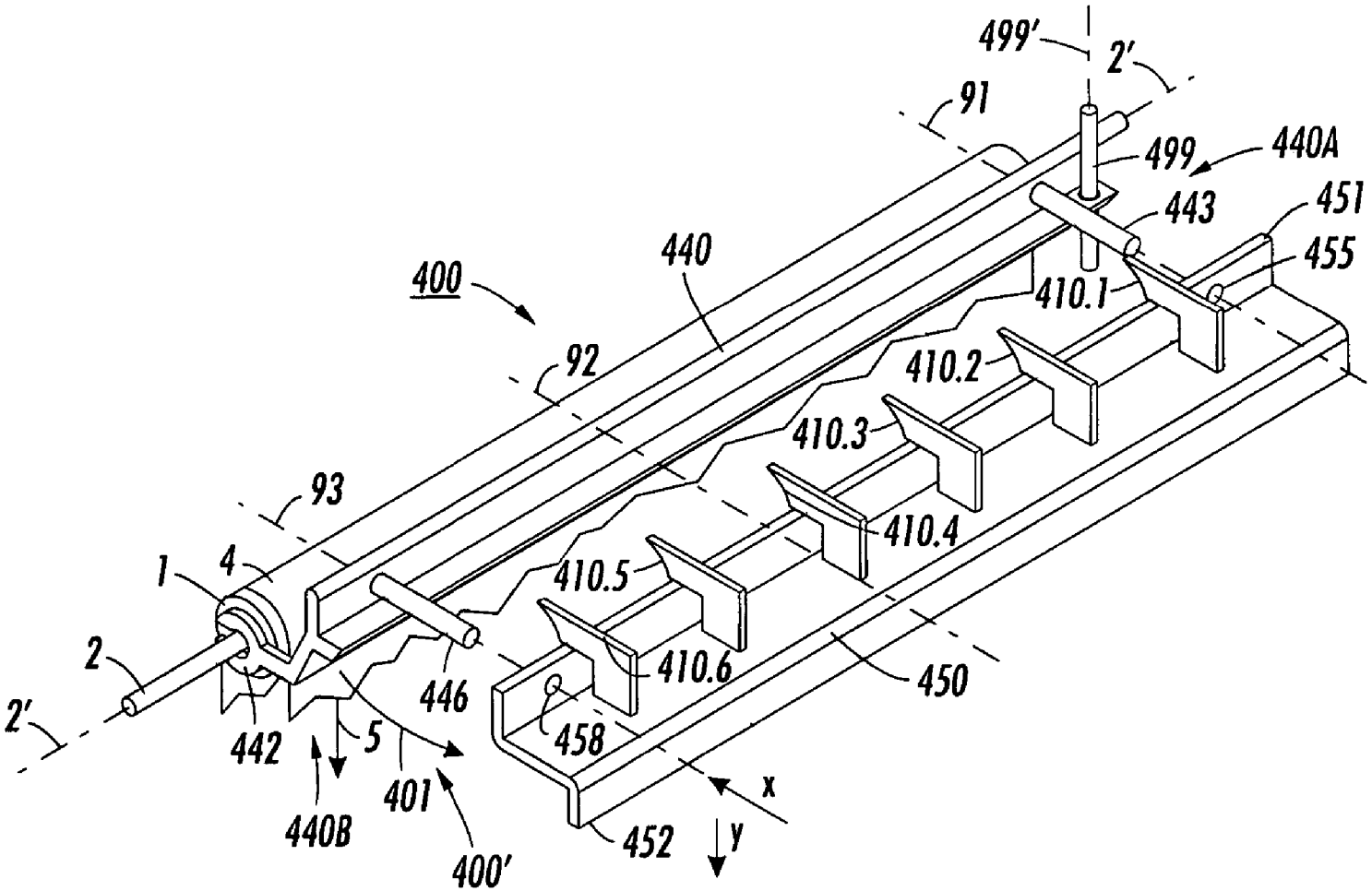
FIG. 4 is a detached elevated perspective view of another embodiment 400 of a stripper assembly, in accordance with the present invention.
Figure 5:
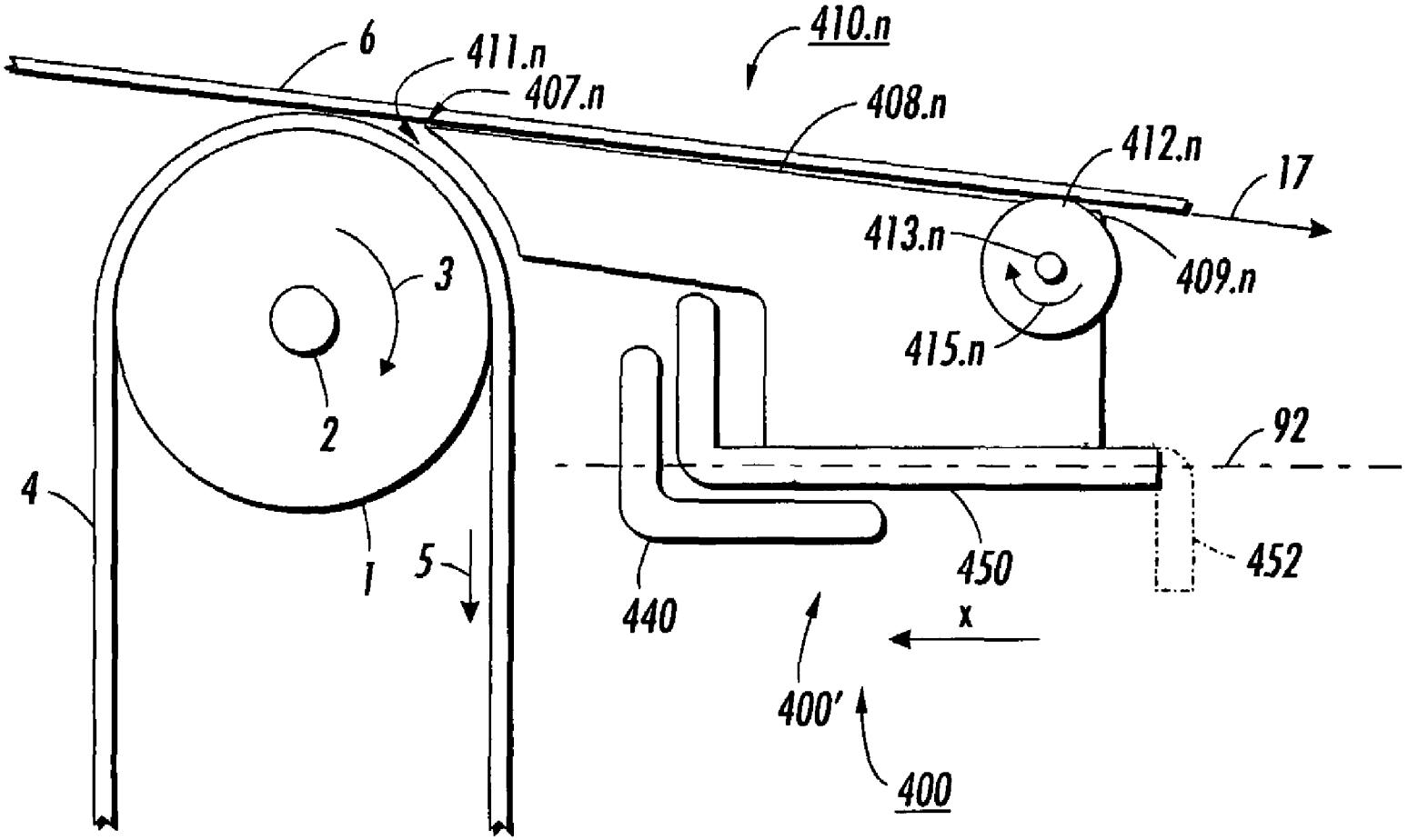
FIG. 5 is a cutaway profile view of the stripper assembly 400 along the reference line 92 of FIG. 4, depicting a typical stripping finger 410.n.

Referring now to FIG. 4, there is shown a detached elevated perspective view of another embodiment 400 of a stripper assembly, in accordance with the present invention. The stripper assembly 400 is arranged to strip a media sheet 6 from a photoreceptor belt 4. (The media sheet 6 is shown in FIG. 5.) The photoreceptor belt 4, in turn, is mounted on a stripper roll 1. As shown, FIG. 4 includes three parallel reference lines 91-93. Reference line 91 is coincident with the axial of an included inboard guide pin 443. Reference line 92 is coincident with a typical included stripping finger 410.n. Reference line 93 coincident with the axial of an included outboard pin guide 446. Also shown is a first arrow labeled X which is parallel to reference lines 91-93 and pointed towards the depicted stripper roll axial 2'. Also shown is a second arrow labeled Y which is orthogonal to both the first arrow X and the stripper roll axial 2'. It will be understood that the arrow X defines a coincident "X axis" and the arrow Y defines a coincident "Y axis".

As shown in FIG. 4, the stripper assembly 400 comprises a support bracket 440 and a finger base 450. Also provided is a pivot axle 499 arranged to be supported by a suitable pivot base such as, for example, a host printing machine housing.

The support bracket 440 is coupled to the stripper roll bearing 2 by means of an included support bracket outboard latch 442. The support bracket outboard latch 442 is detachable from the axle 2, thus enabling the support bracket 440 to rotate or pivot about the pivot axial 499'. The stripper assembly 400 pivot-open travel path is depicted by reference number 401.

The support bracket 440 is arranged to be held stationary or fixed proximate to the photoreceptor belt 4 by means of the outboard latch 442 in a media stripping position 400'.

The support bracket 440 includes an inboard guide pin 443 and a parallel outboard guide pin 446. As shown, the inboard and outboard guide pins 443 and 446 protrude outward away from the support bracket in a direction parallel to the X axis and opposite to the arrow X.

The finger base 450 comprises a multiplicity (N) of six (6) individual stripping fingers respectively depicted by reference numbers 410.1 through 410.6. An included finger base upper lip 451 includes an inboard guide pin hole 455 and an outboard guide pin hole 458.

As shown in FIG. 4, in one embodiment, the finger base 450 includes an optional lower lip 452.

Referring now to FIG. 5, there is shown a cutaway profile view of the stripper assembly 400 along the reference line 92 of FIG. 4, depicting a typical stripping finger 410.n arranged to strip the media sheet 6 from the photoreceptor belt 4.

As shown in FIG. 5, each stripping finger 410 has a protruding distal stripping end 407 and an opposite stripping finger base end 409, with an upper media stripping surface 408 extending therebetween, so that with the support bracket 440 in the media stripping position 400', the corresponding finger distal stripping end 407 extends toward the proximate photoreceptor belt 4 to thereby form a gap 411 with the photoreceptor belt 4. As described below, the magnitude of the stripping finger-photoreceptor belt gap 411 is controlled by adjusting the position or spacing of the finger base 450 with respect to the support bracket 440.

Referring still to FIG. 5, in one embodiment the stripping finger 410 includes an optional stripping finger media support wheel 412 mounted near the stripping finger base end 409 so that the outer edge of the media support wheel 412 extends above the upper media stripping surface 408. As shown, the media 6 travels in path 17, thus causing the media 6 to ride on the top of the support wheel 412. The friction between the moving media 6 and the corresponding upper contact surface of the support wheel 412, in turn, causes the wheel 412 to rotate, which rotation is depicted by reference number 415. In one embodiment, the stripping finger media support wheel 412 is "star shaped", with an outer perimeter comprised of a multiplicity of points such as, for example, the media support wheel 512 described below in connection with FIG. 8.

Referring generally to FIGS. 4-5, the support bracket 440 and the finger base 450 are arranged such that when the finger base 450 moves forward in the direction of the arrow X, the finger base inboard guide pin hole 455 engages the corresponding support bracket inboard guide pin 443, and the finger base outboard guide pin hole 458 engages the corresponding support bracket outboard guide pin 446. Thus engaged, the inboard and outboard guide pins 443 and 446 protrude outward and thereby extend through the respective inboard and outboard guide pin holes 455 and 458. With the finger base 450 thus mounted on the inboard and outboard guide pins 443 and 444, the finger base 450 is thereby movable along the X axis. Thus, the finger base 450 is able to move along the inboard and outboard guide pins 443 and 446 either forward, that is, towards the support bracket 440 in the same direction as the arrow X, or else backward, that is, away from the support bracket 440 in the direction opposite to the arrow X.

As shown in FIG. 5, with the support bracket 440 in the media stripping position 400', moving the finger base 450 forward or toward the support bracket 440, thus decreasing the spacing of the finger base 450 with respect to the support bracket 450, causes the magnitude of the stripping finger-photoreceptor belt gap 411 to decrease. Likewise, moving the finger base 450 backward or away from the support bracket 440, thus increasing the spacing of the finger base 450 with respect to the support bracket 450, causes the magnitude of the stripping finger-photoreceptor belt gap 411 to increase.

Figure 6:
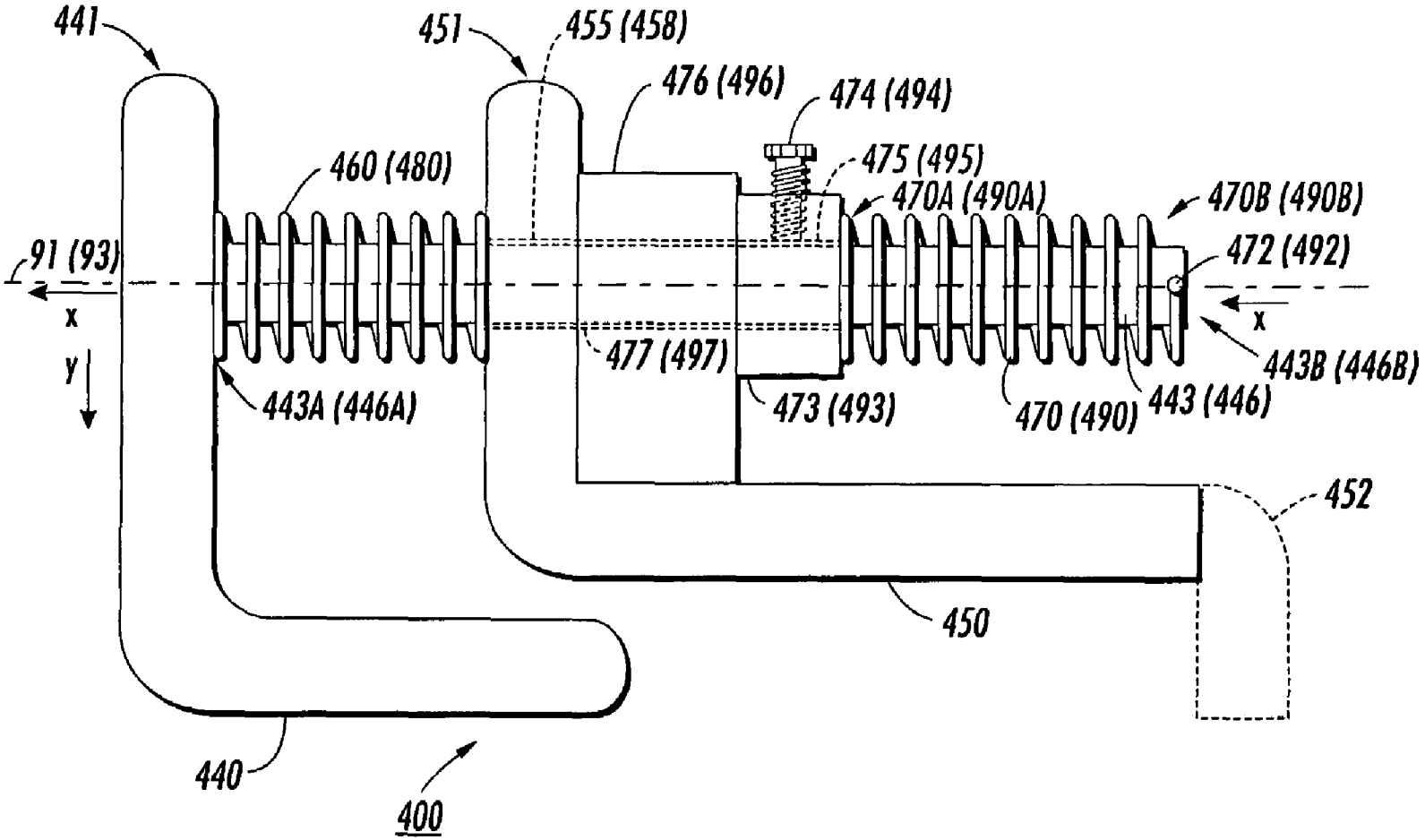
FIG. 6 depicts a first cutaway profile view of the stripper assembly 400 along the reference line 91 of FIG. 4 and also a second cutaway profile view of the stripper assembly along the reference line 93 of FIG. 4.

Referring now to FIG. 6, there is shown a first cutaway profile view of the stripper assembly 400 along the reference line 91 of FIG. 4, and there is also shown a second cutaway profile view of the stripper assembly along the reference line 93 of FIG. 4.

Still referring to FIG. 6, with reference to the first cutaway profile view of the stripper assembly 400 along the reference line 91, as shown, in one embodiment the finger base 450 includes an inboard guide pin load spring 470, an inboard guide pin clamp 473, an inboard guide block 476 and an inboard guide pin return spring 460. The inboard guide pin clamp 473 includes a fastening screw 474 and an inboard clamp guide pin hole 475. The inboard guide block 476 includes an inboard guide block guide pin hole 477. The base end 470B of the inboard guide pin load spring 470 is fixed to the distal end 443B of the inboard guide pin 443 by means of a suitable fastening means 472. In one embodiment, the fastening means 472 comprises an end cap. As shown, from its base end 443A, the body or shaft of inboard guide pin 443 protrudes outward and extends through the inboard guide pin return spring 460, the finger base inboard guide pin hole 455, the inboard guide block guide pin hole 477, the inboard clamp guide pin hole 475 and the inboard guide pin load spring 470.

Still referring to FIG. 6, with reference to the second cutaway profile view of the stripper assembly 400 along the reference line 93, as shown, in one embodiment the finger base 450 includes an outboard guide pin load spring 490, an outboard guide pin clamp 493, an outboard guide block 496 and an outboard guide pin return spring 480. The outboard guide pin clamp 493 includes a fastening screw 494 and an outboard clamp guide pin hole 495. The outboard guide block 496 includes an outboard guide block guide pin hole 497. The base end 490B of the outboard guide pin load spring 490 is fixed to the distal end 446B of the outboard guide pin 446 by means of a suitable fastening means 492. In one embodiment, the fastening means 492 comprises an end cap. As shown, from its base end 446A, the body or shaft of outboard guide pin 446 protrudes outward and extends through the outboard guide pin return spring 480, the finger base outboard guide pin hole 458, the outboard guide block guide pin hole 497, the outboard clamp guide pin hole 495 and the outboard guide pin load spring 490.

In one embodiment, the expansion force of the inboard guide pin load spring 470 is substantially equal to the expansion force of the outboard guide pin load spring 490, and the expansion force of the inboard guide pin return spring 460 is substantially equal to the expansion force of the outboard guide pin return spring 480.

In one embodiment, the expansion force of the inboard guide pin load spring 470 is greater than the expansion force of the inboard guide pin return spring 460, and the expansion force of the outboard guide pin load spring 490 is greater than the expansion force of the outboard guide pin return spring 480.

Still referring to FIG. 6, in one embodiment, the position of the stripping finger base 450 with respect to the support bracket 440 is adjusted by releasing the fastening screws 474 and 494. With the fastening screws 474 and 494 released, the drive ends 470A and 490A of the respective inboard and outboard guide pin load springs 470 and 490 apply corresponding expansion forces against the inboard and outboard clamps 473 and 493. In turn, the inboard and outboard clamps 473 and 493 urge the respective inboard and outboard guide blocks 476 and 496 in a forward direction against the finger base 450.

In one embodiment, the inboard and outboard guide blocks 476 and 496 are attached to the finger base 450 by means of molded bosses included in the guide blocks. The molded bosses, in turn, are fitted to corresponding holes and slots in the finger base 450 and clamped with mounting screws.

The finger base 450 is thus urged to move in a forwards direction along the inboard and outboard guide pins 443 and 446 towards the support bracket 440.

When the finger base 450 arrives at the desired position along the inboard and outboard guide pins 443 and 446, the respective inboard and outboard clamps 473 and 493 are locked in place by means of the corresponding fastening screws 474 and 494. With the inboard and outboard clamps 473 and 493 held in a stationary position by means of their respective fastening screws 474 and 494, the finger base 450 and the inboard and outboard guide blocks 476 and 496 are now held in a stationary position by means of the opposing expansion forces applied to the finger base upper lip 451 by the respective inboard and outboard guide pin return springs 460 and 480.

Referring again to FIG. 4, while the stripper assembly 400 is depicted as comprising a multiplicity (N) of individual stripping fingers 410 wherein the quantity of stripping fingers, represented by the symbol "N", equals 6, those skilled in the art will understand that in an alternate embodiment the stripper assembly 400 comprises a multiplicity (N) of individual stripping fingers 410 wherein N equals a value other than 6.

Thus, in one alternate embodiment of the stripper assembly 400, N equals a value less than 6 such as, for example, 5, 4, or a still lesser value.

Further, in another alternate embodiment of the stripper assembly 400, N equals a value greater than 6 such as, for example, 7, 8, or a still greater value.

Figure 7:
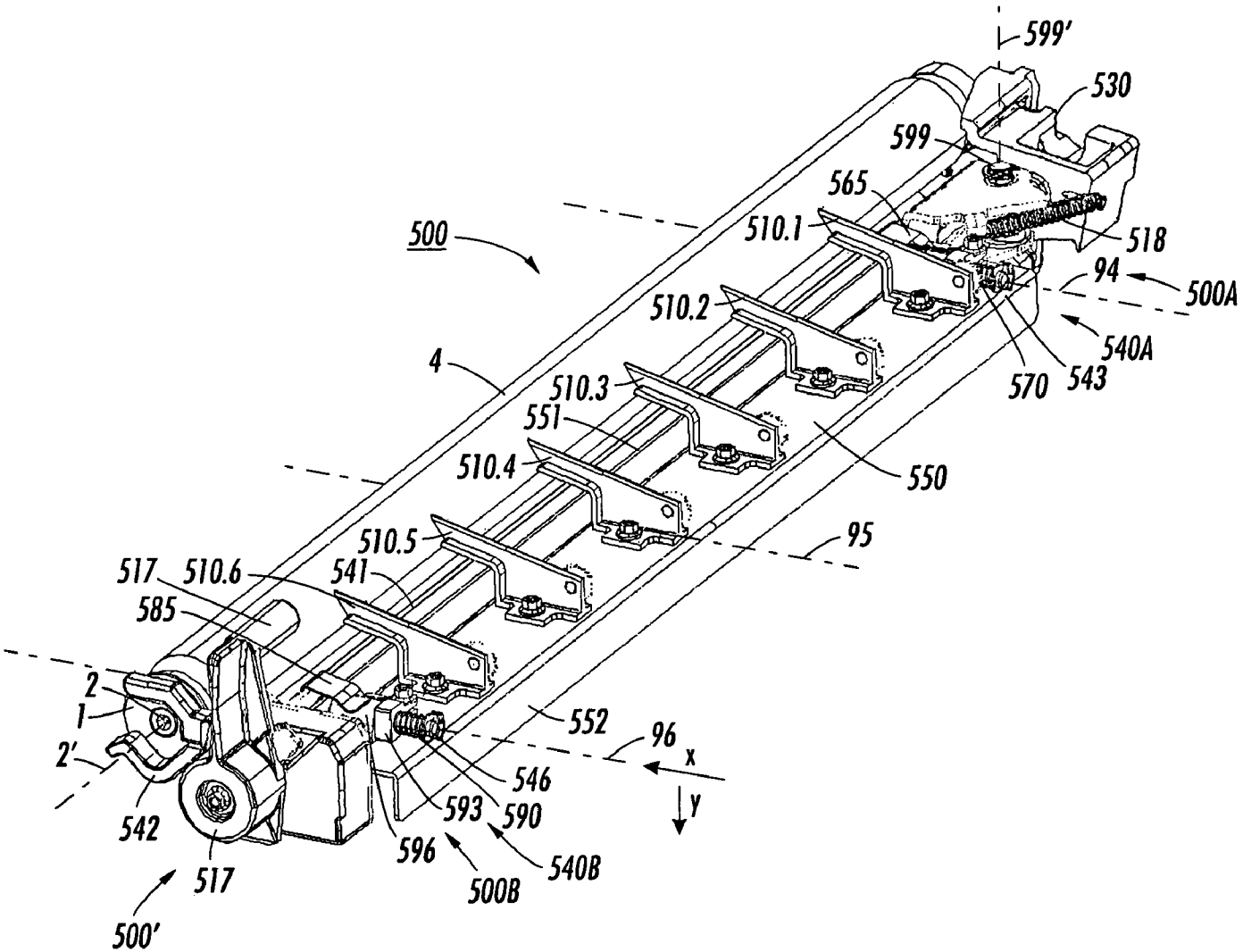
FIG. 7 is a detached elevated perspective view of a further embodiment 500 of a stripper assembly, in accordance with the present invention. As shown, the stripper assembly 500 comprises an stripper assembly inboard end 500A and an stripper assembly outboard end 500B. Also as shown, the stripper assembly 500 comprises individual stripper fingers depicted by reference numbers 510.1 through 510.6, with a typical stripper finger being depicted by reference number 510.n.
Figure 12:
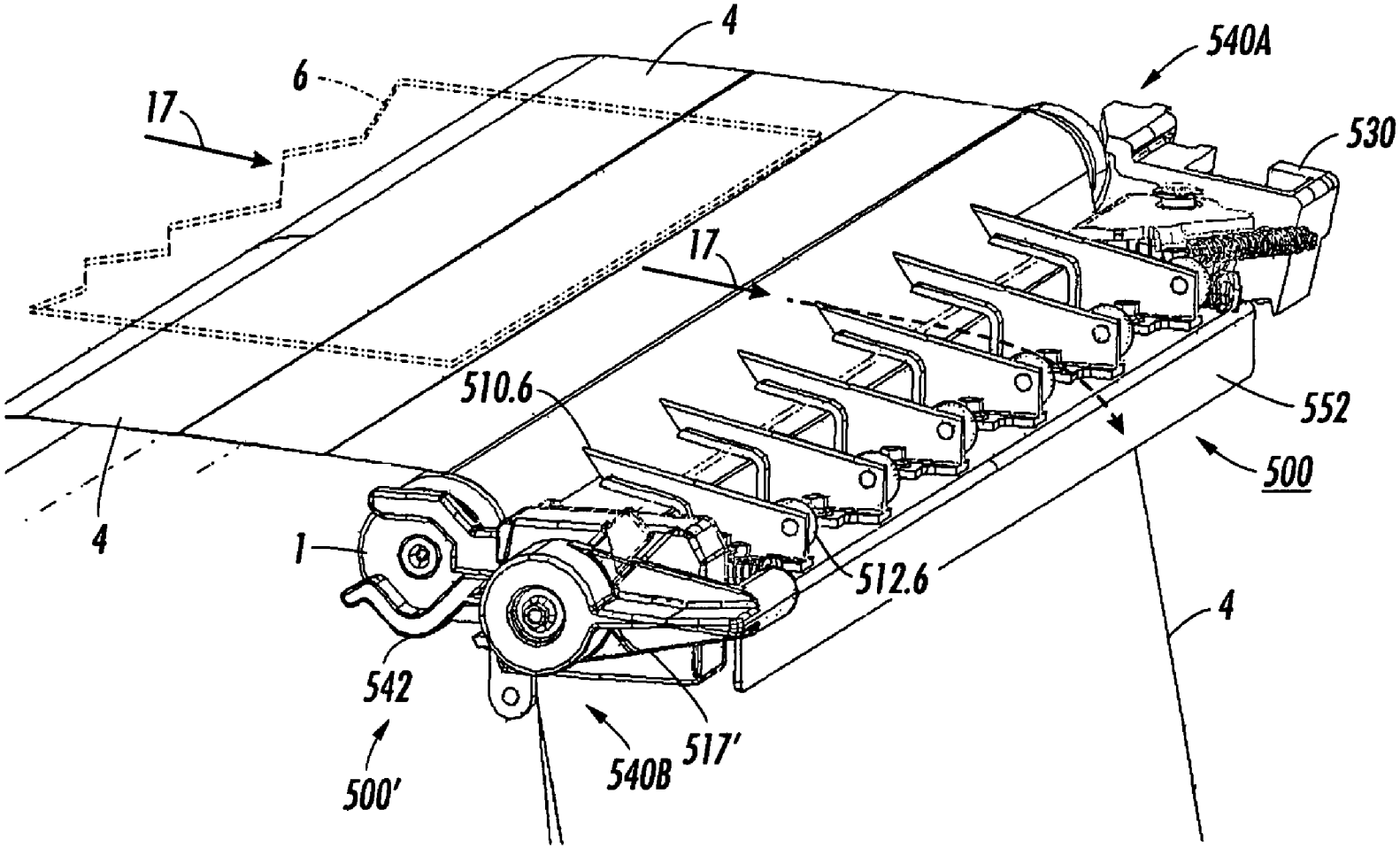
FIG. 12 is another detached elevated perspective view of the stripper assembly 500 with the included handle-pin 517 shown in a rotated-down position depicted by reference number 517'.

Referring now to FIG. 7, there is shown a detached elevated perspective view of a further embodiment 500 of a stripper assembly, in accordance with the present invention. The stripper assembly 500 is arranged to strip a media sheet 6 from a photoreceptor belt 4. (The media sheet 6 is shown in FIG. 12.) The photoreceptor belt 4, in turn, is mounted on a stripper roll 1. As shown, FIG. 7 includes three parallel reference lines 94-96. Reference line 94 is coincident with the axial of an included inboard guide pin 543. Reference line 95 is coincident with a typical included stripping finger 510.n. Reference line 96 coincident with the axial of an included outboard pin guide 546. Also shown is a first arrow labeled X which is parallel to reference lines 94-96 and pointed towards the depicted stripper roll axial 2'. Also shown is a second arrow labeled Y which is orthogonal to both the first arrow X and the stripper roll axial 2'. It will be understood that the arrow X defines a coincident "X axis" and the arrow Y defines a coincident "Y axis".

Figure 8:
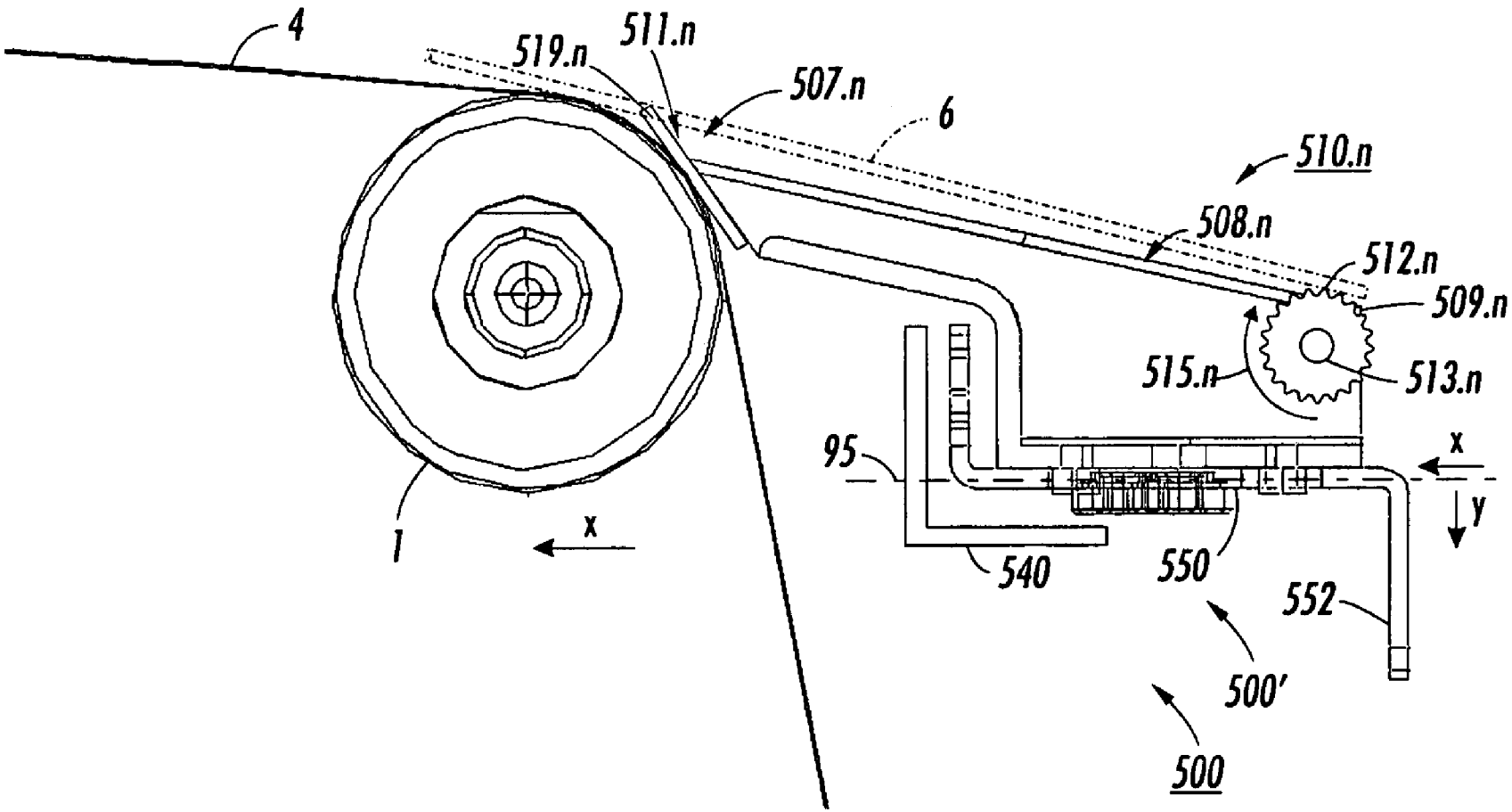
FIG. 8 is a cutaway profile view of the stripper assembly 500 along the reference line 94 of FIG. 7, depicting a typical stripper finger 510.n.

Referring now to FIG. 8, there is shown a cutaway profile view of the stripper assembly 500 along the reference line 95 of FIG. 7, depicting a typical stripping finger 510.n arranged to strip the media sheet 6 from the photoreceptor belt 4.

Figure 9:
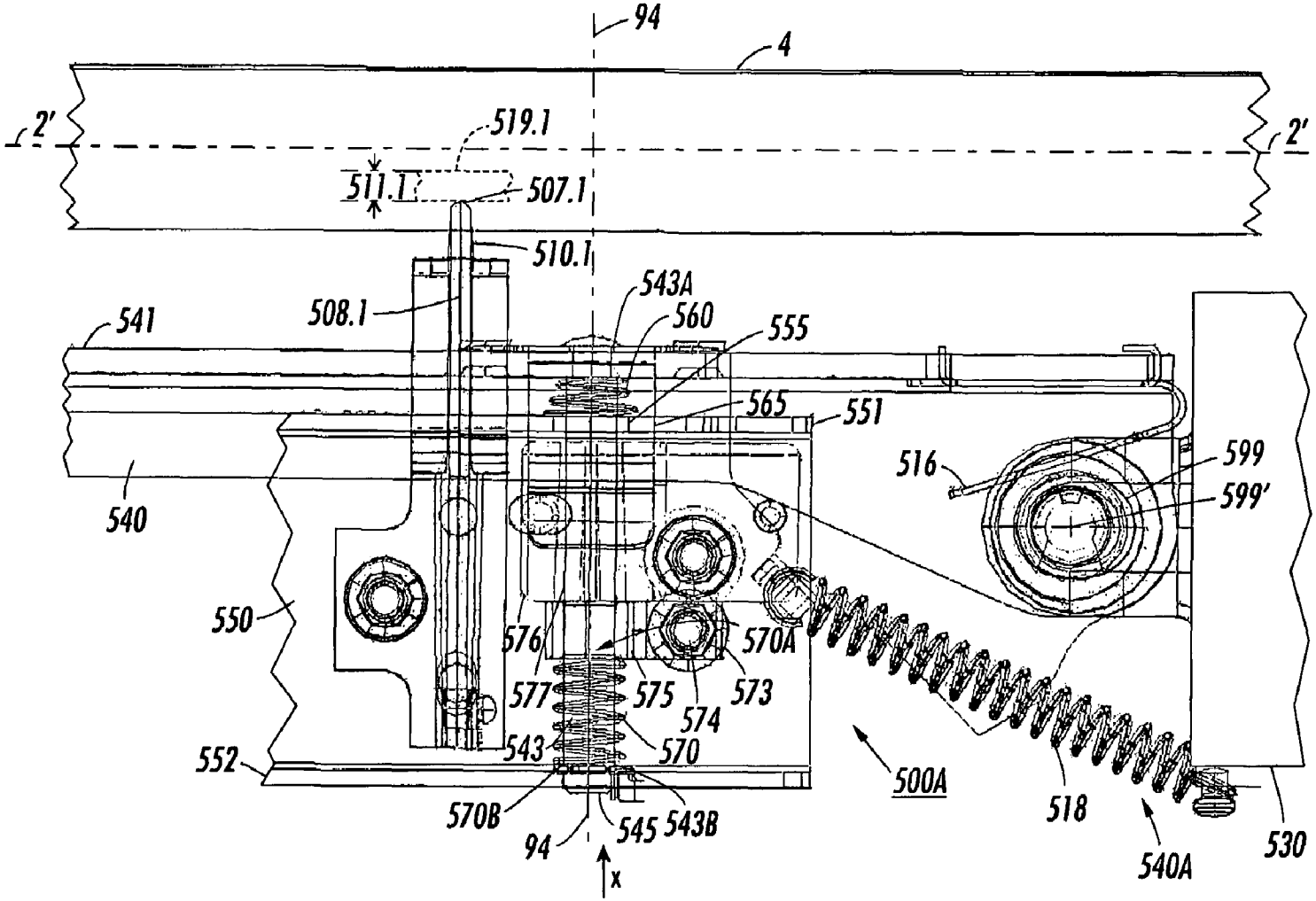
FIG. 9 is an elevated top-down "birds-eye" view of the stripper assembly inboard end 500A.

Referring now to FIG. 9, there is shown an elevated top-down "birds-eye" view of the stripper assembly inboard end 500A.

Figure 10:
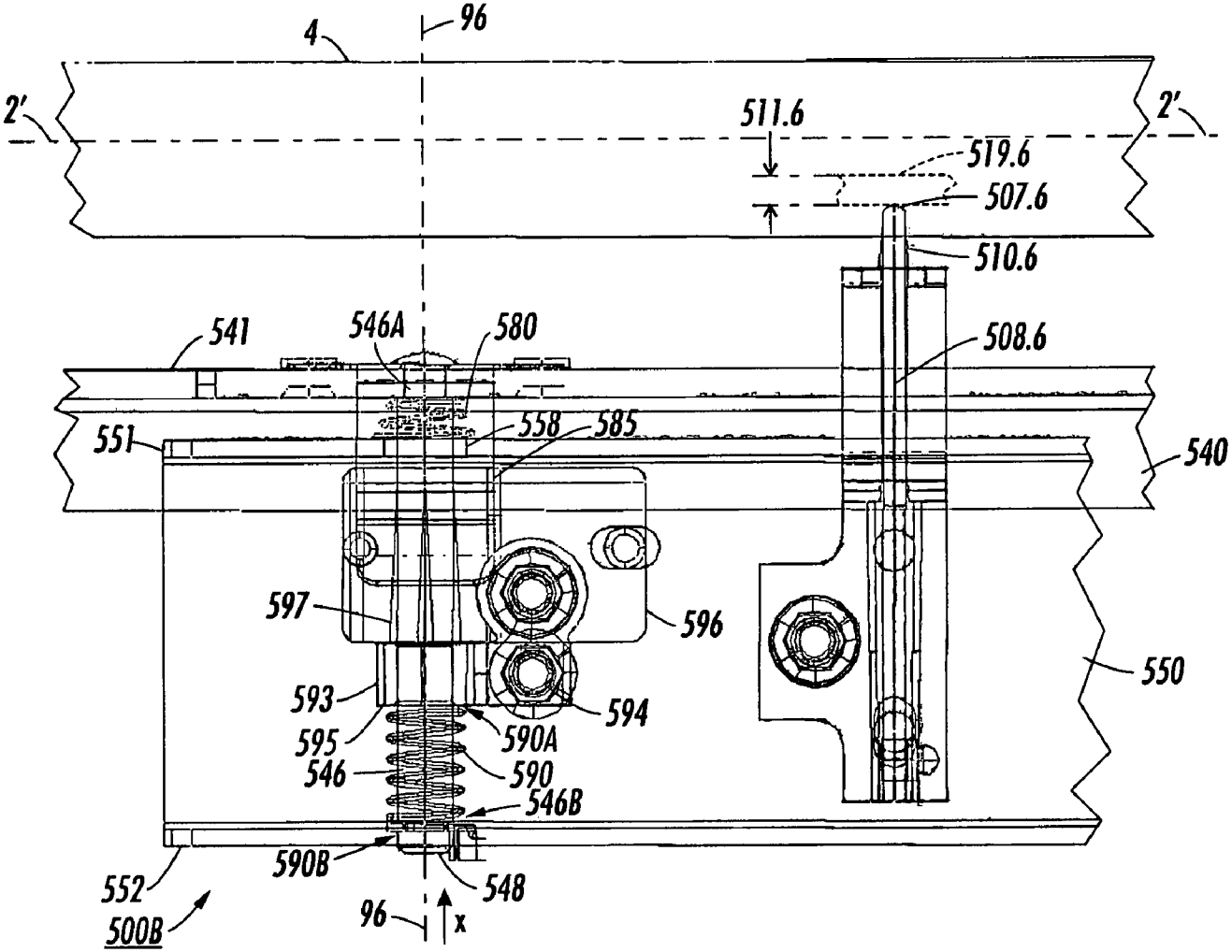
FIG. 10 is an elevated top-down "birds-eye" view of the stripper assembly outboard end 500B.

Referring now to FIG. 10, there is shown an elevated top-down "birds-eye" view of the stripper assembly outboard end 500B.

Referring generally to FIGS. 7-10, as shown therein, the stripper assembly 500 comprises a stripper assembly support bracket 540 and a stripper assembly stripping finger base 550. Also provided is a pivot axle 599 arranged to be supported by a suitable pivot base 530 such as, for example, a host printing machine housing. Also shown are the stripper roll 1 and the stripper roll bearing 2.

In one embodiment, the pivot base 530 comprises a casting on the inboard end of the host printing machine housing.

Figure 11:
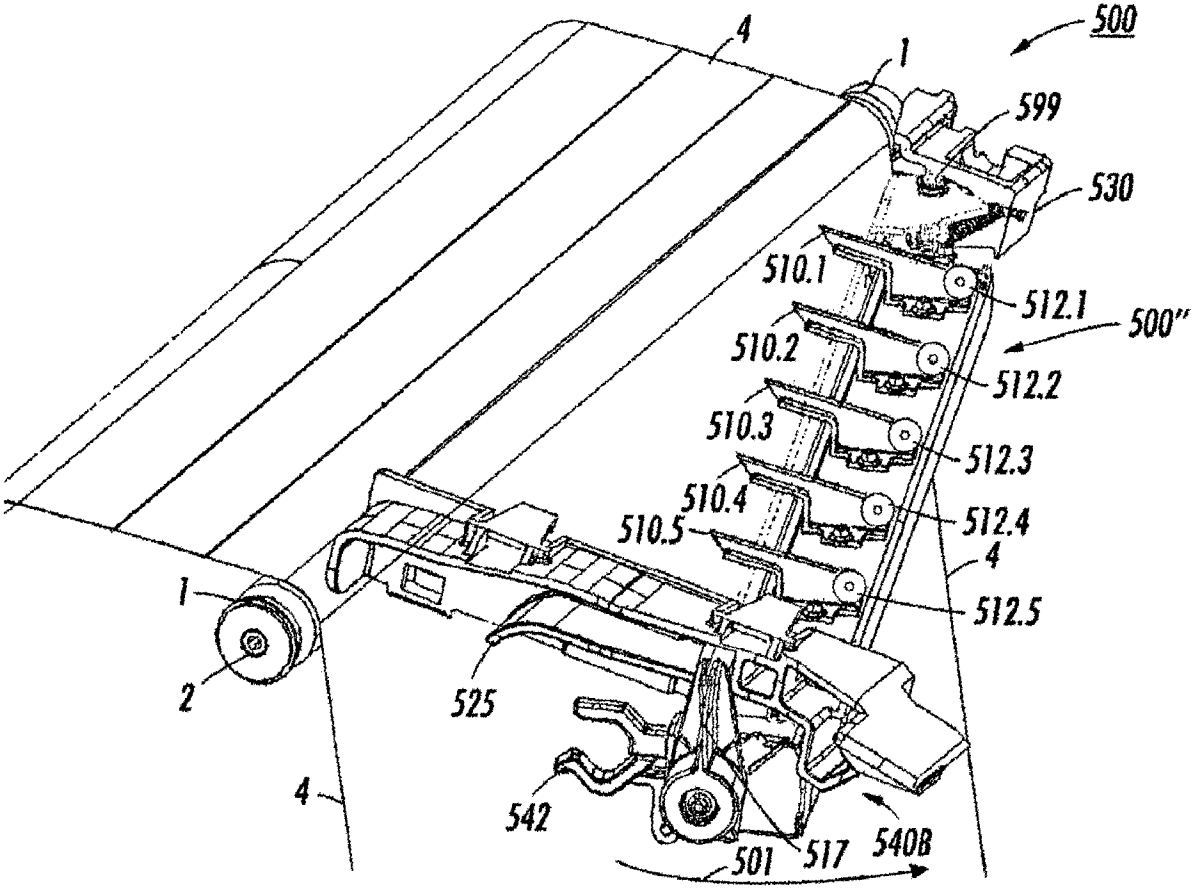
FIG. 11 is a further detached elevated perspective view of the stripper assembly 500 in a pivot-open finger-photoreceptor belt media jam clearance position. depicted by reference number 500".

As shown in FIG. 7, the support bracket 540 is coupled to the stripper roll bearing 2 by means of an included support bracket outboard latch 542. The support bracket outboard latch 542 is detachable from the axle 2, thus enabling the support bracket 540 to rotate or pivot about the pivot axial 599'. (The stripper assembly 500 pivot-open travel path 501 is depicted in FIG. 11.)

The support bracket 540 is arranged to be held stationary or fixed proximate to the photoreceptor belt 4 by means of the outboard latch 542 in a media stripping position 500'.

The support bracket 540 includes an inboard guide pin 543 and a parallel outboard guide pin 546. As shown, the inboard and outboard guide pins 543 and 546 protrude outward away from the support bracket in a direction parallel to the X axis and opposite to the arrow X.

The finger base 550 comprises a multiplicity (N) of six (6) individual stripping fingers respectively depicted by reference numbers 510.1 through 510.6. An included finger base upper lip 551 includes an inboard guide pin hole 555 and an outboard guide pin hole 558.

Referring now to FIG. 8, each stripping finger 510 has a protruding distal stripping end 507 and an opposite stripping finger base end 509, with an upper media stripping surface 508 extending therebetween, so that with the support bracket 540 in the media stripping position 500', the corresponding finger distal stripping end 507 extends toward the proximate photoreceptor belt 4 to thereby form a gap 511 with the photoreceptor belt 4. As described in connection with FIGS. 9-10 below, the magnitude of the stripping finger-photoreceptor belt gap 511 is controlled by adjusting the position or spacing of the finger base 550 with respect to the support bracket 540.

Still referring to FIG. 8, in one embodiment the stripping finger 510 includes an optional stripping finger media support wheel 512 mounted near the stripping finger base end 509 so that the outer edge of the media support wheel 512 extends above the upper media stripping surface 508. As shown in FIG. 12, the media 6 travels in path 17, thus causing the media 6 to ride on the top of the support wheel 512. The friction between the moving media 6 and the corresponding upper contact surface of the support wheel 512, in turn, causes the wheel 512 to rotate, which rotation is depicted by reference number 515. As shown, in one embodiment media support wheel 512 is "star shaped", with an outer perimeter comprised of a multiplicity of points.

Referring now generally to FIGS. 9-10, the support bracket 540 and the finger base 550 are arranged such that when the finger base 550 moves forward in the direction of the arrow X, the finger base inboard guide pin hole 555 engages the corresponding support bracket inboard guide pin 543, and the finger base outboard guide pin hole 558 engages the corresponding support bracket outboard guide pin 546. Thus engaged, the inboard and outboard guide pins 543 and 546 protrude outward and thereby extend through the respective inboard and outboard guide pin holes 555 and 558. With the finger base 550 thus mounted on the inboard and outboard guide pins 543 and 546, the finger base 550 is thereby movable along the X axis. Thus, the finger base 550 is able to move along the inboard and outboard guide pins 543 and 546 either forward, that is, towards the support bracket 540 in the same direction as the arrow X, or else backward, that is, away from the support bracket 540 in the direction opposite to the arrow X.

As shown in FIGS. 9-10, with the support bracket 540 in the media stripping position 500', moving the finger base 550 forward or toward the support bracket 540 decreases the spacing of the finger base 550 with respect to the support bracket 540, thus causing the magnitude of the stripping finger-photoreceptor belt gap 511 to decrease. Likewise, moving the finger base 550 backward or away from the support bracket 540 increases the spacing of the finger base 450 with respect to the support bracket 550, thus causing the magnitude of the stripping finger-photoreceptor belt gap 511 to increase.

Referring now to FIG. 9, the finger base 550 includes an inboard guide pin load spring 570, an inboard guide pin clamp 573, an inboard guide block 576 and an inboard guide pin return spring 560. The inboard guide pin clamp 573 includes a fastening screw 574 and an inboard clamp guide pin hole 575. The inboard guide block 576 includes an inboard guide block guide pin hole 577. The base end 570B of the inboard guide pin load spring 570 is fixed to the distal end 543B of the inboard guide pin 543 by means of an end cap 545. As shown, from its base end 543A, the body or shaft of inboard guide pin 543 protrudes outward and extends through the inboard guide pin return spring 560, the finger base inboard guide pin hole 555, the inboard guide block guide pin hole 577, the inboard clamp guide pin hole 575 and the inboard guide pin load spring 570.

Referring now to FIG. 10, the finger base 550 further includes an outboard guide pin load spring 590, an outboard guide pin clamp 593, an outboard guide block 596 and an outboard guide pin return spring 580. The outboard guide pin clamp 593 includes a fastening screw 594 and an outboard clamp guide pin hole 595. The outboard guide block 596 includes an outboard guide block guide pin hole 597. The base end 590B of the outboard guide pin load spring 590 is fixed to the distal end 546B of the outboard guide pin 546 by means of an end cap 548. As shown, from its base end 546A, the body or shaft of outboard guide pin 546 protrudes outward and extends through the outboard guide pin return spring 580, the finger base outboard guide pin hole 558, the outboard guide block guide pin hole 597, the outboard clamp guide pin hole 595 and the outboard guide pin load spring 590.

Referring to FIGS. 9-10, in one embodiment, the inboard and outboard guide blocks 576 and 596 are attached to the finger base 550 by means of molded bosses included in the guide blocks. The molded bosses, in turn, are fitted to corresponding holes and slots in the finger base 550 and clamped with mounting screws.

In one embodiment, the expansion force of the inboard guide pin load spring 570 is substantially equal to the expansion force of the outboard guide pin load spring 590, and the expansion force of the inboard guide pin return spring 560 is substantially equal to the expansion force of the outboard guide pin return spring 580.

In one embodiment, the expansion force of the inboard guide pin load spring 570 is greater than the expansion force of the inboard guide pin return spring 560, and the expansion force of the outboard guide pin load spring 590 is greater than the expansion force of the outboard guide pin return spring 580.

The support bracket 540 includes an inboard bias spring 565 (shown in FIG. 9) and an outboard bias spring 585 (shown in FIG. 10). The inboard bias spring 565 applies a downward force, that is, in the direction of the arrow Y, against the upper surface of the inboard guide block 576. Likewise, the outboard bias spring 585 applies a downward Y-direction force against the upper surface of the outboard guide block 596. As shown, the outboard end of support bracket 540 also includes a handle-pin 517 (shown in FIG. 7).

As shown in FIG. 9, the support bracket 540 is coupled to the pivot axle 599 by means of a support bracket pivot-open bias spring 516. Also, the support bracket 540 is coupled to the pivot base 530 by means of a finger base pivot-open bias spring 518.

Referring now generally to FIGS. 8-10, in one embodiment, the stripping finger-photoreceptor belt gap 511 is adjusted to the desired value by positioning a plurality of gap-setting inserts or stops 519 between the photoreceptor belt 4 and the stripping finger distal stripping ends 507 of a corresponding plurality of stripping fingers 510, wherein the thickness of each individual insert or stop 519 is a known value. In one embodiment, the thickness of each insert 519 of the plurality of inserts is equal to the same value.

As shown in FIGS. 9-10, for example, in one embodiment a first gap-setting insert 519.1 and a second gap-setting insert 519.6 are positioned between the photoreceptor belt 4 and the respective stripping finger distal stripping ends 507.1 and 507.6 of the corresponding stripping fingers 510.1 and 510.6.

With the inserts or stops 519.1 and 519.6 thus inserted, the inboard and outboard guide pin clamp fastening screws 574 and 594 are then released.

With the clamp fastening screws 574 and 594 released, the expansion forces of the inboard and outboard guide pin load springs 570 and 590 thereby cause the stripping finger base 550 and the attached stripper fingers 510.1 through 510.6 to move forward, that is, in the same direction as the arrow X, until the finger distal stripping ends 507.1 and 507.6 respectively contact the inserts or stops 519.1 and 519.6. When this contact occurs, the stripper fingers 510.1 through 510.6 cease moving forward and, as a result, the corresponding stripping finger-photoreceptor belt gaps 511.1 through 511.6 now equal the same thickness value as the inserts or stops 519.1 and 519.6.

With the finger distal stripping ends 507.1 and 507.6 firmly contacting the inserts or stops 519.1 and 519.6, the clamp fastening screws 574 and 594 are now activated or tightened, thus locking the stripping finger base 550 and the attached stripper finger 510.1 through 510.6 in position along the X axis.

With the stripper fingers 510.1 through 510.6 thus locked in position along the X axis, the inserts or stops 519.1 and 519.6 are removed.

With the inserts or stops 519.1 and 519.6 removed, the stripping finger base 550 and the attached stripper fingers 510.1 through 510.6 are prevented from moving backwards, that is, in the direction opposite to the arrow X, as a result of the now-activated inboard and outboard guide pin clamps 573 and 593. Also with the inserts or stops 519.1 and 519.6 removed, the stripping finger base 550 and the attached stripper fingers 510.1 through 510.6 likewise are prevented from moving forward, that is, in the same direction as the arrow X, as a result of the expansion forces applied by the inboard and outboard guide pin return springs 560 and 580. As a result, the stripper fingers 510.1 through 510.6 are held stationary along the X-axis, thus setting the corresponding stripping finger-photoreceptor belt gaps 511.1 through 511.6 to the desired value based on the predetermined thickness of the inserts or stops 519.1 and 519.6.

Still referring to FIGS. 9-10, while the stripping finger-photoreceptor belt gap 511 is depicted as being adjusted by means of using exactly two (2) gap-setting inserts or stops 519, those skilled in the art will understand that in an alternate embodiment another quantity of gap-setting inserts is used to adjust the gap 511. For example, in one embodiment only one (1) gap-setting insert 519 is used to adjust the gap 511. In another embodiment, a greater quantity such as, for example, three (3) or more gap-setting inserts are used to adjust the gap 511.

Also, while FIGS. 9-10 depict the stripping finger-photoreceptor belt gap 511 being adjusted by means of positioning the plural gap-setting inserts 519 between the photoreceptor belt 4 and the stripping finger distal stripping ends 507.1 and 507.6 of the corresponding stripping fingers 510.1 and 510.6, those skilled in the art will understand that in an alternate embodiment the plural gap-setting inserts 519 are positioned between the photoreceptor belt 4 and the stripping finger distal stripping ends of corresponding different stripping fingers. For example, in one embodiment a first gap-setting insert 519.2 and a second gap-setting insert 519.5 are positioned between the photoreceptor belt 4 and the respective stripping finger distal stripping ends 507.2 and 507.5 of the corresponding stripping fingers 510.2 and 510.5.

Referring again to FIG. 7, while the stripper assembly 500 is depicted as comprising a multiplicity (N) of individual stripping fingers 510 wherein the quantity of stripping fingers, represented by the symbol "N", equals 6, those skilled in the art will understand that in an alternate embodiment the stripper assembly 500 comprises a multiplicity (N) of individual stripping fingers 510 wherein N equals a value other than 6.

Thus, in one alternate embodiment of the stripper assembly 500, N equals a value less than 6 such as, for example, 5, 4, or a still lesser value.

Further, in another alternate embodiment of the stripper assembly 500, N equals a value greater than 6 such as, for example, 7, 8, or a still greater value.

Referring now to FIG. 11, there is shown a further detached elevated perspective view of the stripper assembly 500. The stripper assembly 500 is shown in a pivot-open finger-photoreceptor belt media jam clearance position 500". The stripper assembly pivot-open finger-photoreceptor belt media jam clearance position 500" travel path is depicted by reference number 501. In moving along the travel path 501, the outboard side of the support bracket 540 travels on an included guide track 525. As shown, each of the depicted stripping fingers 510.1 through 510.5 respectively includes a corresponding star-shaped media support wheel 512.1 through 512.5.

Referring now to FIG. 12, there is shown another detached elevated perspective view of the stripper assembly 500. The handle-pin 517 is shown in a rotated-down position 517' for normal paper jam clearance. As shown, the depicted stripping finger 510.6 includes a corresponding star-shaped media support wheel 512.6. Also shown is the media sheet 6 and the media travel path 17.

Figure 13:
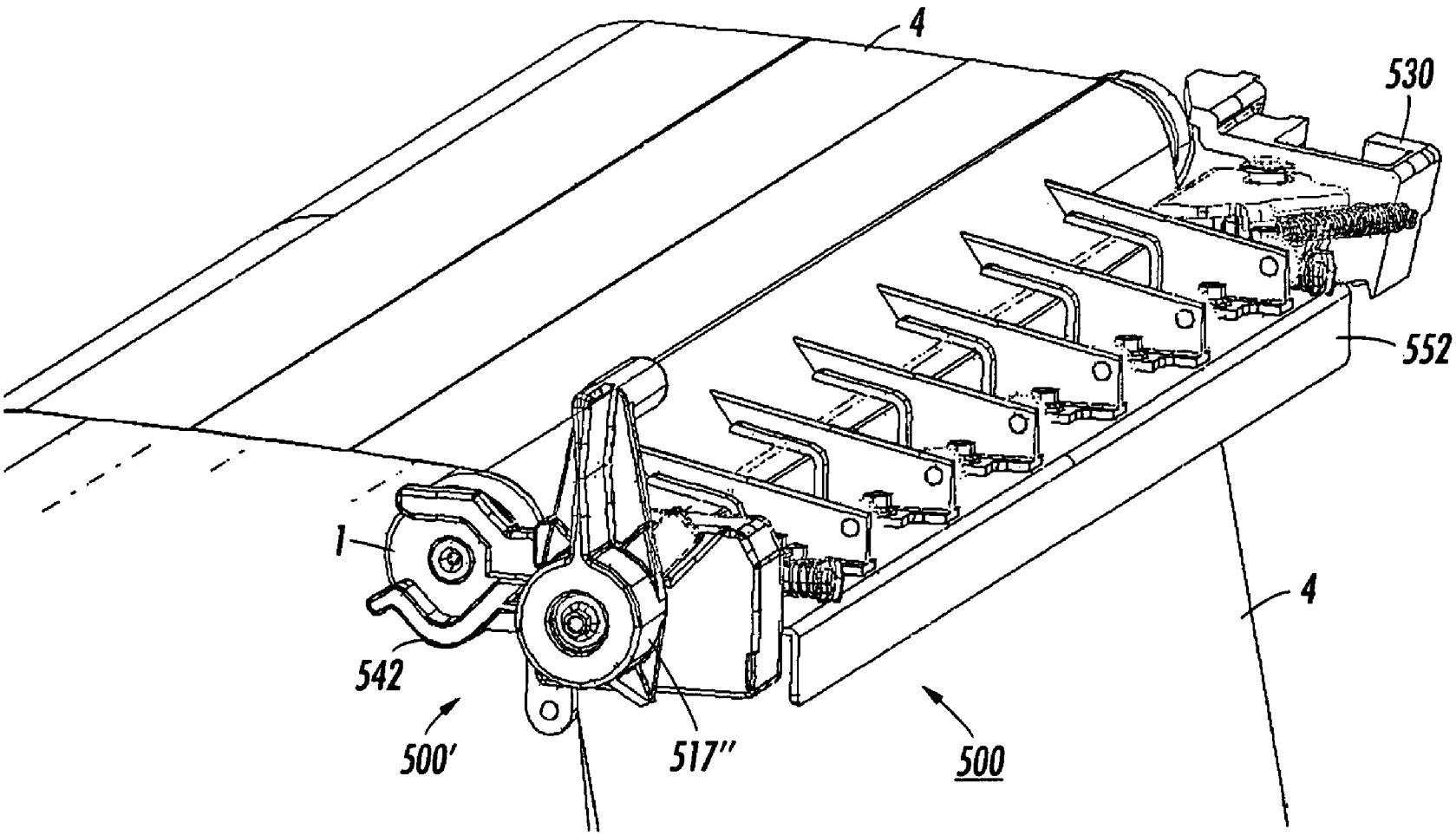
FIG. 13 is a still further detached elevated perspective view of the stripper assembly 500 with the handle-pin 517 shown in a rotated-up position depicted by reference number 517".

Referring now to FIG. 13, there is shown a still further detached elevated perspective view of the stripper assembly 500. The handle-pin 517 is shown in a rotated-up position 517" prior to opening the stripper assembly 500 for finger-photoreceptor belt 4 jam clearance.

Figure 14:
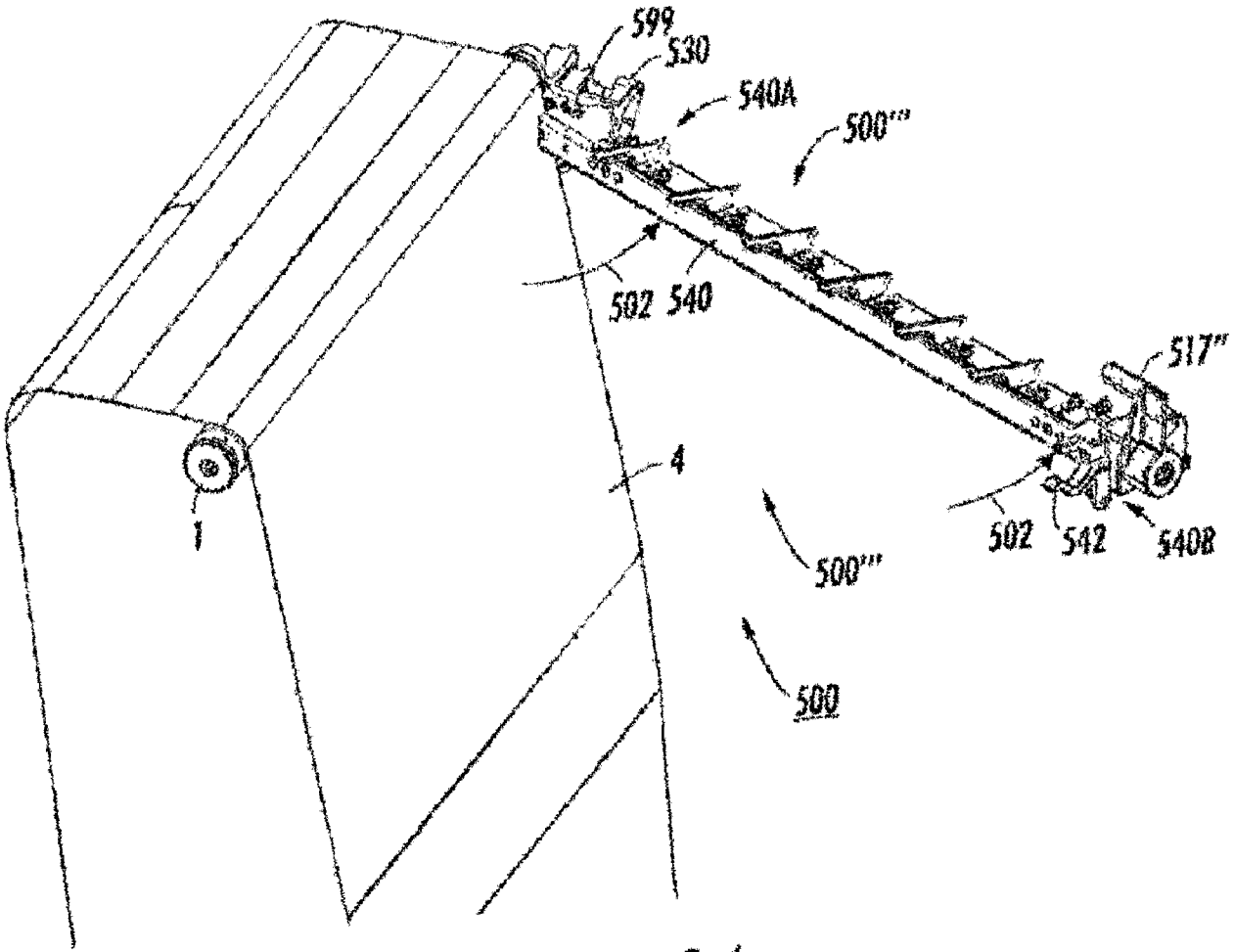
FIG. 14 is still another detached elevated perspective view of the stripper assembly 500 shown in a pivot-open service position depicted by reference number 500'".

Referring now to FIG. 14, there is shown still another detached elevated perspective view of the stripper assembly 500. The stripper assembly 500 is shown in a pivot-open service position 500'". Such service may include, for example, replacing the photoreceptor belt 4. The stripper assembly pivot-open service position 500'" travel path is depicted by reference number 502.

Figure 15:
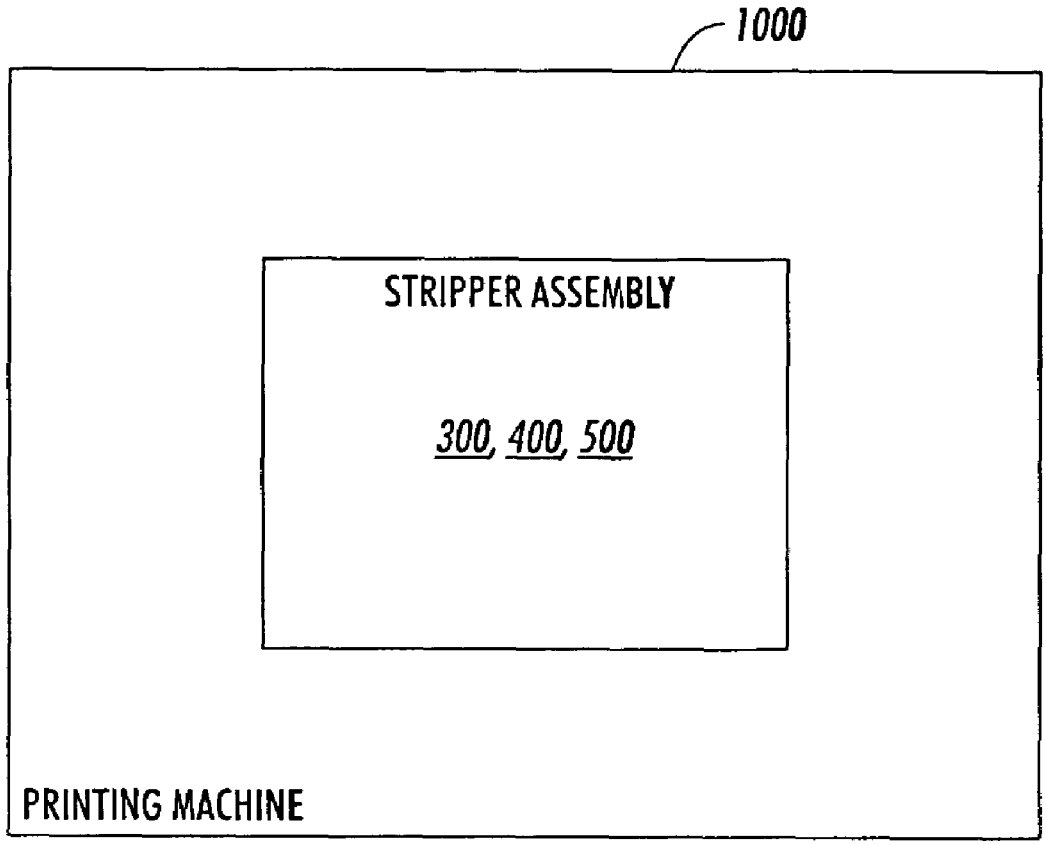
FIG. 15 is a block diagram depicting a xerographic printing machine 1000 wherein the machine 1000 includes any of the stripper assembly 300 of FIG. 3, the stripper assembly 400 of FIGS. 4-6 and the stripper assembly 500 of FIGS. 7-14.

Referring now to FIG. 15, there is a block diagram depicting a xerographic printing machine 1000. As shown, the machine 1000 includes any of the stripper assembly 300 described above in connection with FIG. 3, the stripper assembly 400 described above in connection with FIGS. 4-6 and the stripper assembly 500 described above in connection with FIGS. 7-14.

Referring still to FIG. 15, in one embodiment the printing machine 1000 comprises a copy machine. In another embodiment the printing machine 1000 comprises a network printer.

Thus, in one embodiment, the present invention mounts the stripping finger assembly on inboard and outboard guide pins and uses springs to accurately locate the finger assembly with respect to the photoreceptor belt at the stripper roll. Clamps are then tightened on the guide pins to keep the finger assembly in position and adds no external forces or deflections to the stripper assembly, thus maintaining accuracy, consistency and removing the subjectivity relative to gap set-up. In one embodiment, the invention is mounted on a pivot at the inboard side, thus enabling customer opening for jam clearance.

In one embodiment, the invention consists of a sheet metal support bracket which uses inboard and outboard guide pins to mount and locate the finger base with the attached stripping fingers. The support bracket is mounted to a casting on the inboard side and latches to the stripper roll bearing on the outboard side. The finger base has a conical hole/slot in plastic guides which accurately locate in the Y axis and the Z axis yet allow movement along the X axis and rotation on the Y axis about the guide pins without binding. A load spring is applied at both guide pins to bias the finger base against gap-setting inserts ("hard stops"), with the load springs being selected to over-power the return springs, on the photoreceptor stripper roll during set-up. A clamp at each guide pin is then tightened locking in the location of the finger base. At this point the load springs have no effect on the finger base location. A return spring is also located on both guide pins opposite the load springs. After the clamps have been tightened and the hard stops removed, the return springs keep the finger base located in its desired set-up position.

This invention is intended to have a repeatable gap within 0.05 mm upon opening and closing the stripper assembly for paper jam clearance. Further, this invention is supported and pivots on a casting at its inboard side, swinging open for paper jam removal. Spring forces are applied to bias and control all fit clearances to keep the stripping finger-photoreceptor belt gap tolerances to a minimum. The outboard end has a latch which accurately locates and clamps to the photoreceptor stripper roll bearing. This latch has a handle-guide pin which rides in a track controlling the stripper assembly motion when swinging open for stripping finger-photoreceptor belt jam removal. This handle-guide pin also rotates 90 degrees for other types of paper jam removal. In the down position the mechanism locks, and the handle must be in the up position for the customer to unlatch and swing the stripper assembly open. This prevents the customer from ever getting the stripper assembly out of position relative to the track. Further, as the photoreceptor module is opened (slid out on slides), this stripper assembly disengages from the track and is swung open to a service position for photoreceptor belt replacement.

Some advantages of this invention include allowing customer jam clearance access, thus preventing a call to customer service and most likely a visit by a service technician and a repeatable stripping finger-photoreceptor belt gap setting as hereinafter described. In the previous stripper assembly, the gap variation as measured over a typical number of machine cycles was 1.15 mm with a standard deviation of 0.3 mm. In contrast, with the present invention, the corresponding gap variation is advantageously reduced to 0.056 mm, with the corresponding standard deviation likewise being advantageously reduced to 0.015 mm. These repeatable improved gap setting allow the nominal gap to be reduced to the best possible gap for performance, thus reducing the amount of jams that a customer would have to clear. For good understanding, the aforementioned measured values of variation and standard deviation are based on the present stripper assembly mechanism, a perfect stripper roll and a perfect photoreceptor belt. In reality, our roll has a curved surface and runout with respect to turning about its center. The stripper roll surface contour also varies due to the tension applied to it by the photoreceptor belt. Belt tension varies due to belt length tolerances and tension mechanism tolerances. Also, our photoreceptor belt has a seam (a substantial contributor) and variations about the seam due to the joining process. Also the photoreceptor belt thickness varies. It thus will be understood that, as a result of all these contributing factors, the actual gap magnitude must be greater than 0.056 mm plus some small nominal gap.

Thus, there has been described the first aspect of the invention, namely, a stripper assembly (any of the stripper assembly 400 and the stripper assembly 500) arranged to strip a media sheet (6) from a photoreceptor belt (4); the stripper assembly comprising a support bracket (440, 540) arranged to support an included stripping finger base (450, 550), the stripping finger base having a multiplicity of individual stripping fingers (410, 510) attached thereto; the support bracket arranged to be fixed proximate to the photoreceptor belt in a media stripping position (400', 500'); each stripping finger having a protruding distal stripping end (407, 507) and an opposite stripping finger base end (409, 509), with an upper media stripping surface (408, 508) extending therebetween, so that with the support bracket in the media stripping position the corresponding finger distal stripping end extends toward the proximate photoreceptor belt to thereby form a gap (411, 511) with the photoreceptor belt; the support bracket arranged to pivot about a pivot axial (499', 599') located at an included support bracket inboard end (440A, 540A), the opposite support bracket outboard end (450B, 550B) being releasable (by means of the detachable support bracket outboard latch 442, 542) to thus enable the support bracket to pivot (401, 501) away from the photoreceptor belt.

In one embodiment of the stripper assembly (any of the stripper assembly 400 and the stripper assembly 500), the support bracket (440, 540) comprises an inboard guide pin (443, 543) and a parallel outboard guide pin (446, 546), the corresponding inboard and outboard guide pin distal ends (443B, 543B, 446B, 546B) protruding outward away from the support bracket, the stripping finger base having an inboard guide pin hole (455, 555) and an outboard guide pin hole (458, 558) arranged for respectively engaging the inboard and outboard guide pins, thus enabling the stripping finger base to move along the inboard and outboard guide pins either towards or away from the support bracket.

In one embodiment, the stripper assembly (any of the stripper assembly 400 and the stripper assembly 500) includes an inboard guide pin load spring (470, 570) positioned at the inboard guide pin distal end and an outboard guide pin load spring (490, 590) positioned at the outboard guide pin distal end (446B, 546B), the inboard and outboard guide pin load springs arranged to apply corresponding inboard and outboard load spring expansion forces against the stripping finger base, thereby urging the stripping finger base to move towards the support bracket.

In one embodiment, the stripper assembly (any of the stripper assembly 400 and the stripper assembly 500) includes an inboard guide pin clamp (473, 573) positioned between the inboard guide pin load spring and the stripping finger base and an outboard guide pin clamp (493, 593) positioned between the outboard guide pin load spring and the stripping finger base, the inboard and outboard guide pin clamps arranged to control (by means of the fastening screws 474, 574) the application of the corresponding inboard and outboard load spring expansion forces against the stripping finger base.

In one embodiment, the stripper assembly (any of the stripper assembly 400 and the stripper assembly 500) includes an inboard guide pin return spring (460, 560) positioned at the inboard guide pin base end (443A, 543A) and an outboard guide pin return spring (480, 580) positioned at the outboard guide pin base end (446A, 546A), the inboard and the outboard guide pin return springs arranged to apply corresponding inboard and outboard return spring expansion forces against the stripping finger base, thereby urging the stripping finger base to move away from the support bracket.

In one embodiment, the stripper assembly (any of the stripper assembly 400 and the stripper assembly 500) includes an inboard guide block (476, 576) positioned between the inboard guide pin clamp and the stripping finger base and an outboard guide block (496, 596) positioned between the outboard guide pin clamp and the stripping finger base.

In one embodiment of the stripper assembly (any of the stripper assembly 400 and the stripper assembly 500), each stripping finger includes a stripping finger media support wheel (412, 512) mounted near the stripping finger base end.

In one embodiment of the stripper assembly (any of the stripper assembly 400 and the stripper assembly 500), the media support wheel is star-shaped (such as the media support wheel 512).

In one embodiment, the stripper assembly (any of the stripper assembly 400 and the stripper assembly 500) comprises exactly six (6) stripping fingers.

In one embodiment of the stripper assembly (any of the stripper assembly 400 and the stripper assembly 500), the photoreceptor belt is mounted on a stripper roll (1), the support bracket outboard end including a latch (the support bracket outboard latch 442, 542) arranged for coupling to an included stripper roll bearing (2).

Also, there has been described the second aspect of the invention, namely, a stripper assembly (any of the stripper assembly 400 and the stripper assembly 500) arranged to strip a media sheet (6) from a photoreceptor belt (4); the stripper assembly comprising a support bracket (440, 540) arranged to support an included stripping finger base (450, 550); the support bracket arranged to be fixed (by means of the support bracket outboard latch 442, 542) proximate to the photoreceptor belt in a media stripping position (400', 500'); the stripping finger base having a multiplicity of individual stripping fingers (410, 510) attached thereto, each stripping finger having a protruding distal stripping end (407, 507) and an opposite stripping finger base end (409, 509), with an upper media stripping surface (408, 508) extending therebetween, so that with the support bracket in the media stripping position the corresponding finger distal stripping end extends toward the proximate photoreceptor belt to thereby form a gap (411, 511) with the photoreceptor belt; the support bracket comprising an inboard guide pin (443, 543) and a parallel outboard guide pin (446, 546), the corresponding inboard and outboard guide pin distal ends (443B, 543B, 446B, 546B) protruding outward away from the support bracket; the stripping finger base having an inboard guide pin hole (455, 555) and an outboard guide pin hole (458, 558) arranged for respectively engaging the inboard and outboard guide pins, thus enabling the stripping finger base to move along the inboard and outboard guide pins either towards or away from the support bracket.

In one embodiment of the stripper assembly (any of the stripper assembly 400 and the stripper assembly 500), the support bracket is arranged to pivot about a pivot axial (499', 599') located at an included support bracket inboard end (440A, 540A), the opposite support bracket outboard end (450B, 550B) being releasable (by means of the detachable support bracket outboard latch 442, 542) to thus enable the support bracket to pivot (401, 501) away from the photoreceptor belt.

Also, there has been described the third aspect of the invention, namely, a printing machine (1000) including a stripper assembly (any of the stripper assembly 400 and the stripper assembly 500) arranged to strip a media sheet (6) from an included photoreceptor belt (4); the stripper assembly comprising a support bracket (440, 540) arranged to support an included stripping finger base (450, 550), the stripping finger base having a multiplicity of individual stripping fingers (410, 510) attached thereto; the support bracket arranged to be fixed proximate to the photoreceptor belt in a media stripping position (400', 500'); each stripping finger having a protruding distal stripping end (407, 507) and an opposite stripping finger base end (409, 509), with an upper media stripping surface (408, 508) extending therebetween, so that with the support bracket in the media stripping position the corresponding finger distal stripping end extends toward the proximate photoreceptor belt to thereby form a gap (411, 511) with the photoreceptor belt; the support bracket arranged to pivot about a pivot axial (499', 599') located at an included support bracket inboard end (440A, 540A), the opposite support bracket outboard end (450B, 550B) being releasable (by means of the detachable stripper assembly outboard latch 352) to thus enable the support bracket to pivot (401, 501) away from the photoreceptor belt.

In one embodiment, the printing machine (1000) comprises any of a copy machine and a network printer.

Also, there has been described the fourth aspect of the invention, namely, a printing machine (1000) including a stripper assembly (any of the stripper assembly 400 and the stripper assembly 500) arranged to strip a media sheet (6) from an included photoreceptor belt (4); the stripper assembly comprising a support bracket (440, 540) arranged to support an included stripping finger base (450, 550); the support bracket arranged to be fixed (by means of the support bracket outboard latch 442, 542) proximate to the photoreceptor belt in a media stripping position (400', 500'); the stripping finger base having a multiplicity of individual stripping fingers (410, 510) attached thereto, each stripping finger having a protruding distal stripping end (407, 507) and an opposite stripping finger base end (409, 509), with an upper media stripping surface (408, 508) extending therebetween, so that with the support bracket in the media stripping position the corresponding finger distal stripping end extends toward the proximate photoreceptor belt to thereby form a gap (411, 511) with the photoreceptor belt; the support bracket comprising an inboard guide pin (443, 543) and a parallel outboard guide pin (446, 546), the corresponding inboard and outboard guide pin distal ends (443B, 543B, 446B, 546B) protruding outward away from the support bracket; the stripping finger base having an inboard guide pin hole (455, 555) and an outboard guide pin hole (458, 558) arranged for respectively engaging the inboard and outboard guide pins, thus enabling the stripping finger base to move along the inboard and outboard guide pins either towards or away from the support bracket.

Also, there has been described the fifth aspect of the invention, namely, a stripper assembly (300) arranged to strip a media sheet (6) from a photoreceptor belt (4); the stripper assembly stripping finger base (350), the stripping finger base having a multiplicity of individual stripping fingers (10) attached thereto; the stripping finger base arranged to be fixed proximate to the photoreceptor belt in a media stripping position (300'); each stripping finger having a protruding distal stripping end (7) and an opposite stripping finger base end (9), with an upper media stripping surface (8) extending therebetween, so that with the stripping finger base in the media stripping position the corresponding finger distal stripping end extends toward the proximate photoreceptor belt to thereby form a gap (11) with the photoreceptor belt; the stripping finger base arranged to pivot about a pivot axial (399') located at an included stripping finger base inboard end (350A), the opposite stripping finger base outboard end (350B) being releasable (by means of the stripper assembly outboard latch 352) to thus enable the stripping finger base to pivot (301) away from the photoreceptor belt.

Also, there has been described the sixth aspect of the invention, namely, a printing machine (1000) including a stripper assembly (300) arranged to strip a media sheet (6) from an included photoreceptor belt (4); the stripper assembly stripping finger base (350), the stripping finger base having a multiplicity of individual stripping fingers (10) attached thereto; the stripping finger base arranged to be fixed proximate to the photoreceptor belt in a media stripping position (300'); each stripping finger having a protruding distal stripping end (7) and an opposite stripping finger base end (9), with an upper media stripping surface (8) extending therebetween, so that with the stripping finger base in the media stripping position the corresponding finger distal stripping end extends toward the proximate photoreceptor belt to thereby form a gap (11) with the photoreceptor belt; the stripping finger base arranged to pivot about a pivot axial (399') located at an included stripping finger base inboard end (350A), the opposite stripping finger base outboard end (350B) being releasable (by means of the stripper assembly outboard latch 352) to thus enable the stripping finger base to pivot (301) away from the photoreceptor belt.

The table below lists the drawing element reference numbers together with their corresponding written description:

| Ref. No.: | Description: |
|---|---|
| 1 | stripper roll |
| 2 | stripper roll bearing |
| 2' | stripper roll axial |
| 3 | stripper roll rotation |

-continued

| Ref. No.: | Description: |
|---|---|
| 4 | photoreceptor belt |
| 5 | photoreceptor belt travel path |
| 6 | media or paper |
| 7 | stripping finger distal stripping end |
| 7.n | typical stripping finger distal stripping end |
| 8 | stripping finger stripping surface |
| 8.n | typical stripping finger stripping surface |
| 9 | stripping finger base end |
| 9.n | typical stripping finger base end |
| 10 | stripping finger |
| 10.1–10.6 | stripping fingers |
| 10.n | typical stripping finger |
| 11 | stripping finger-photoreceptor belt gap |
| 11.1–11.6 | stripping finger-photoreceptor belt gap |
| 11.n | typical stripping finger-photoreceptor belt gap |
| 12.n | typical stripping finger media support wheel |
| 13.n | typical stripping finger media support wheel axle |
| 14.n | typical stripping finger media support wheel axle hole |
| 15.n | typical stripping finger media support wheel rotation |
| 17 | media travel path, spanwise or downstream direction |
| 18 | upstream direction |
| 20 | stripper assembly base |
| 23 | inboard direction |
| 24 | outboard direction |
| 91 | reference line, coincident with inboard guide pin 443 axial |
| 92 | reference line, coincident with typical stripping finger 410.n |
| 93 | reference line, coincident with outboard guide pin 446 axial |
| 94 | reference line, coincident with inboard guide pin 543 axial |
| 95 | reference line, coincident with typical stripping finger 510.n |
| 96 | reference line, coincident with outboard guide pin 546 axial |
| 100 | stripper assembly |
| 100A | stripper assembly inboard end |
| 100B | stripper assembly outboard end |
| 300 | stripper assembly |
| 300' | stripper assembly in media stripping position |
| 300" | stripper assembly in pivot-open position |
| 301 | stripper assembly pivot-open travel path |
| 330 | pivot base |
| 350 | stripping finger base |
| 350A | stripping finger base inboard end |
| 350B | stripping finger base outboard end |
| 352 | stripper assembly support bracket outboard latch |
| 399 | pivot axle |
| 399' | pivot axial |
| 400 | stripper assembly |
| 400' | stripper assembly in media stripping position |
| 401 | stripper assembly pivot-open travel path |
| 407.n | typical stripping finger distal stripping end |
| 408.n | typical stripping finger stripping surface |
| 409.n | typical stripping finger base end |
| 410.1–410.6 | stripping fingers |
| 410.n | typical stripping finger |
| 411.n | typical stripping finger-photoreceptor belt gap |
| 412.n | typical stripping finger media support wheel |
| 413.n | typical stripping finger media support wheel axle |
| 415.n | typical stripping finger media support wheel rotation |
| 430 | pivot base |
| 440 | stripper assembly support bracket |
| 440A | support bracket inboard end |
| 440B | support bracket outboard end |
| 441 | support bracket upper lip |
| 442 | support bracket outboard latch |
| 443 | support bracket inboard guide pin |
| 443A | inboard guide pin base end |
| 443B | inboard guide pin distal end |
| 446 | support bracket outboard guide pin |
| 446A | outboard guide pin base end |
| 446B | outboard guide pin distal end |
| 450 | stripping finger base |
| 451 | finger base upper lip |
| 452 | optional finger base lower lip |
| 455 | finger base inboard guide pin hole |
| 458 | finger base outboard guide pin hole |
| 460 | inboard guide pin return spring |
| 470 | inboard guide pin load spring |
| 470A | inboard guide pin load spring drive end |
| 470B | inboard guide pin load spring base end |

-continued

| Ref. No.: | Description: |
|---|---|
| 472 | inboard guide pin load spring fastening means |
| 473 | inboard guide pin clamp |
| 474 | inboard guide pin clamp fastening screw |
| 475 | inboard clamp guide pin hole |
| 476 | inboard guide block |
| 477 | inboard guide block guide pin hole |
| 480 | outboard guide pin return spring |
| 490 | outboard guide pin load spring |
| 490A | outboard guide pin load spring drive end |
| 490B | outboard guide pin load spring base end |
| 492 | outboard guide pin load spring fastening means |
| 493 | outboard guide pin clamp |
| 494 | outboard guide pin clamp fastening screw |
| 495 | outboard clamp guide pin hole |
| 496 | outboard guide block |
| 497 | outboard guide block guide pin hole |
| 499 | pivot axle |
| 499' | pivot axial |
| 500 | stripper assembly |
| 500A | stripper assembly inboard end |
| 500B | stripper assembly outboard end |
| 500' | stripper assembly in media stripping position |
| 500" | stripper assembly in pivot-open position for clearing stripping finger-photoreceptor belt media jam |
| 500"' | stripper assembly in pivot-open position for service such as, for example, replacing the photoreceptor belt |
| 501 | stripper assembly pivot-open travel path for clearing finger-photoreceptor belt media jam position |
| 502 | stripper assembly pivot-open travel path for service position |
| 507 | stripping finger distal stripping end |
| 507.n | typical stripping finger distal stripping end |
| 508 | stripping finger stripping surface |
| 508.1 | stripping finger stripping surface |
| 508.6 | stripping finger stripping surface |
| 508.n | typical stripping finger stripping surface |
| 509 | stripping finger base end |
| 509.n | typical stripping finger base end |
| 510.1–510.6 | stripping fingers |
| 510.n | typical stripping finger |
| 511 | stripping finger-photoreceptor belt gap |
| 511.1 | gap for stripping finger 510.1 |
| 511.6 | gap for stripping finger 510.6 |
| 511.n | typical stripping finger-photoreceptor belt gap |
| 512.1 | stripping finger media support wheel |
| 512.2 | stripping finger media support wheel |
| 512.3 | stripping finger media support wheel |
| 512.4 | stripping finger media support wheel |
| 512.5 | stripping finger media support wheel |
| 512.6 | stripping finger media support wheel |
| 512.n | typical stripping finger media support wheel |
| 513.n | typical stripping finger media support wheel axle |
| 515.n | typical stripping finger media support wheel rotation |
| 516 | support bracket pivot-open bias spring |
| 517 | handle-pin |
| 517' | handle-pin rotated down for normal paper jam clearance |
| 517" | handle-pin rotated up prior to opening stripper assembly for finger-photoreceptor belt media jam clearance |
| 518 | finger base pivot-open bias spring |
| 519.1 | gap-setting insert for gap 511.1 |
| 519.6 | gap-setting insert for gap 511.6 |
| 519.n | typical gap-setting insert |
| 525 | guide track |
| 530 | pivot base |
| 540 | stripper assembly support bracket |
| 540A | support bracket inboard end |
| 540B | support bracket outboard end |
| 541 | support bracket upper lip |
| 542 | support bracket outboard latch |
| 543 | support bracket inboard guide pin |
| 543A | inboard guide pin base end |
| 543B | inboard guide pin distal end |
| 545 | inboard guide pin distal end cap |
| 546 | support bracket outboard guide pin |
| 546A | outboard guide pin base end |
| 546B | outboard guide pin distal end |
| 548 | outboard guide pin distal end cap |
| 550 | stripping finger base |

-continued

| Ref. No.: | Description: |
|---|---|
| 551 | finger base upper lip |
| 552 | finger base lower lip |
| 555 | finger base inboard guide pin hole |
| 558 | finger base outboard guide pin hole |
| 560 | inboard guide pin return spring |
| 565 | inboard bias spring |
| 570 | inboard guide pin load spring |
| 570A | inboard guide pin load spring drive end |
| 570B | inboard guide pin load spring base end |
| 573 | inboard guide pin clamp |
| 574 | inboard guide pin clamp fastening screw |
| 575 | inboard clamp guide pin hole |
| 576 | inboard guide block |
| 577 | inboard guide block guide pin hole |
| 580 | outboard guide pin return spring |
| 585 | outboard bias spring |
| 590 | outboard guide pin load spring |
| 590A | outboard guide pin load spring drive end |
| 590B | outboard guide pin load spring base end |
| 593 | outboard guide pin clamp |
| 594 | outboard guide pin clamp fastening screw |
| 595 | outboard clamp guide pin hole |
| 596 | outboard guide block |
| 597 | outboard guide block guide pin hole |
| 599 | pivot axle |
| 599' | pivot axial |
| 1000 | printing machine |

While various embodiments of a method of actuating a cleaning system and a printing machine including the same, in accordance with the present invention, are described above, the scope of the invention is defined by the following claims.

What is claimed is:

1. A stripper assembly arranged to strip a media sheet from a photoreceptor belt;

the stripper assembly comprising a support bracket arranged to support an included stripping finger base;

the support bracket arranged to be fixed proximate to the photoreceptor belt in a media stripping position;

the stripping finger base having a multiplicity of individual stripping fingers attached thereto, each stripping finger having a protruding distal stripping end and an opposite stripping finger base end, with an upper media stripping surface extending therebetween, so that with the support bracket in the media stripping position the corresponding finger distal stripping end extends toward the proximate photoreceptor belt to thereby form a gap with the photoreceptor belt;

the support bracket comprising an inboard guide pin and a parallel outboard guide pin, the corresponding inboard and outboard guide pin distal ends protruding outward away from the support bracket;

the stripping finger base having an inboard guide pin hole and an outboard guide pin hole arranged for respectively engaging the inboard and outboard guide pins, thus enabling the stripping finger base to move along the inboard and outboard guide pins either towards or away from the support bracket;

the support bracket arranged to pivot about a pivot axial located at an included support bracket inboard end, the opposite support bracket outboard end being releasable to thus enable the support bracket to pivot away from the photoreceptor belt;

including an inboard guide pin load spring positioned at the inboard guide pin distal end and an outboard guide pin load spring positioned at the outboard guide pin distal end, the inboard and outboard guide pin load springs arranged to apply corresponding inboard and outboard load spring expansion force against the stripping finger base, thereby urging the stripping finger base to move towards the support bracket;

including an inboard guide pin clamp positioned between the inboard guide pin load spring and the stripping finger base and an outboard guide pin clamp positioned between the outboard guide pin load spring and the stripping finger base, the inboard and outboard guide pin clamps arranged to control the application of the corresponding inboard and outboard load spring expansion forces against the stripping finger base; and including an inboard guide pin return spring positioned at the inboard guide pin base end and an outboard guide pin return spring positioned at the outboard guide pin base end, the inboard and the outboard guide pin return springs arranged to apply corresponding inboard and outboard return spring expansion forces against the stripping finger base, thereby urging the stripping finger base to move away from the support bracket.

2. The stripper assembly of claim 1 including an inboard guide block positioned between the inboard guide pin claim and the stripping finger base and including an outboard guide block positioned between the outboard guide pin claim and the stripping finger base.

3. The stripper assembly of claim 1, each stripping finger having a stripping finger media support wheel mounted near the stripping finger base end.

4. The stripper assembly of claim 3, the media support wheel being star-shaped.

5. The stripper assembly of claim 1, comprising exactly six (6) stripping fingers.

6. The stripper assembly of claim 1, the photoreceptor belt mounted on a stripper roll, the support bracket outboard end including a latch arranged for coupling to an included stripper roll bearing.

7. A printing machine including a stripper assembly arranged to strip a media sheet from an included photoreceptor belt;

the stripper assembly comprising a support bracket arranged to support an included stripping finger base;

the support bracket arranged to be fixed proximate to the photoreceptor belt in a media stripping position;

the stripping finger base having a multiplicity of individual stripping fingers attached thereto, each stripping finger having a protruding distal stripping end and an opposite stripping finger base end, with an upper media stripping surface extending therebetween, so that with the support bracket in the media stripping position the corresponding finger distal stripping end extends toward the proximate photoreceptor belt to thereby form a gap with the photoreceptor belt;

the support bracket comprising an inboard guide pin and a parallel outboard guide pin, the corresponding inboard and outboard guide pin distal ends protruding outward away from the support bracket;

the stripping finger base having an inboard guide pin hole and an outboard guide pin hole arranged for respectively engaging the inboard and outboard guide pins, thus enabling the stripping finger base to move along the inboard and outboard guide pins either towards or away from the support bracket;

the support bracket arranged to pivot about a pivot axial located at an included support bracket inboard end, the opposite support bracket outboard end being releasable to thus enable the support bracket to pivot away from the photoreceptor belt;

the stripper assembly including an inboard guide pin load spring positioned at the inboard guide pin distal end and an outboard guide pin load spring positioned at the outboard guide pin distal end, the inboard and outboard guide pin load springs arranged to apply corresponding inboard and outboard load spring expansion force against the stripping finger base, thereby urging the stripping finger base to move towards the support bracket;

the stripper assembly including an inboard guide pin clamp positioned between the inboard guide pin load spring and the stripping finger base and an outboard guide pin clamp positioned between the outboard guide pin load spring and the stripping finger base, the inboard and outboard guide pin clamps arranged to control the application of the corresponding inboard and outboard load spring expansion forces against the stripping finger base; and the stripper assembly including an inboard guide pin return spring positioned at the inboard guide pin base end and an outboard guide pin return spring positioned at the outboard guide pin base end, the inboard and the outboard guide pin return springs arranged to apply corresponding inboard and outboard return spring expansion forces against the stripping finger base, thereby urging the stripping finger base to move away from the support bracket.

8. The printing machine of claim 7, the stripper assembly including an inboard guide block positioned between the inboard guide pin clamp and the stripping finger base and including an outboard guide block positioned between the outboard guide pin clamp and the stripping finger base.

9. The printing machine of claim 7, each stripping finger having a stripping finger media support wheel mounted near the stripping finger base end.

10. The printing machine of claim 9, the media support wheel being star-shaped.

11. The printing machine of claim 7, the stripper assembly comprising exactly six (6) stripping fingers.

12. The printing machine of claim 7 comprising any of a copy machine and a network printer.

* * * * *